United States Patent [19]

Morris

[11] 4,101,314

[45] Jul. 18, 1978

[54] PROCESS FOR RECOVERY OF LEAD FROM LEAD SULFIDE CONCENTRATES

[75] Inventor: Arthur E. Morris, Rolla, Mo.

[73] Assignee: The Curators of the University of Missouri, Columbia, Mo.

[21] Appl. No.: 797,936

[22] Filed: May 18, 1977

Related U.S. Application Data

[63] Continuation of Ser. No. 674,836, Apr. 8, 1976, abandoned, which is a continuation of Ser. No. 575,354, May 7, 1975, abandoned.

[51] Int. Cl.[2] ..... C22B 13/00

[52] U.S. Cl. ..... 75/77

[58] Field of Search ..... 75/77, 78

[56] References Cited

U.S. PATENT DOCUMENTS

| | | | |
|---|---|---|---|
| 821,330 | 5/1906 | Betts | 75/77 |
| 1,306,942 | 6/1919 | Berglund | 75/77 |
| 1,642,358 | 9/1927 | Chisholm | 75/77 |
| 2,733,989 | 2/1956 | Greffe | 75/77 |
| 2,823,990 | 2/1958 | Barwasser et al. | 75/77 |
| 2,850,375 | 9/1958 | Bertrand | 75/77 |

OTHER PUBLICATIONS

Matsukawa et al., *Tech Report of Osaka U.* Japan, No. 272, Oct. 1957.

*Primary Examiner*—M. J. Andrews

*Attorney, Agent, or Firm*—Koenig, Senniger, Powers and Leavitt

[57] ABSTRACT

A process of recovery of lead from a lead sulfide concentrate. In this process, a furnace charge is prepared comprising the lead concentrate, a source of elemental iron and a source of available oxygen capable of reacting with the sulfur of the concentrate to form an oxysulfide matte. The relative proportions of the concentrate, source of elemental iron and source of oxygen are such that the sum of the elemental iron content and sulfur-reducible iron content of the charge is at least about 1.1 pound atoms per pound atom of sulfur based on the total sulfur content of the charge, and the oxygen source provides between about 0.25 and about 0.5 pound atoms available oxygen per pound atom of sulfur based on the total sulfur content of the charge. The charge is heated to a temperature of at least about 1,050° C. and maintained at such temperature to effect reduction of lead sulfide with elemental iron, while limiting access of air to the charge to substantially prevent formation of sulfur dioxide therein. Thus, the formation of elemental lead and a matte containing partially oxygenated iron sulfide occurs without substantial evolution of sulfur dioxide. The elemental lead is separated from the matte.

6 Claims, 17 Drawing Figures

PHASE DIAGRAM FOR THE Fe-O-S SYSTEM (DOT IS THE MATTE COMPOSITION FROM CHEMICAL ANALYSIS)

ACTIVITIES OF FeO AND FeS IN THE LIQUID OXYSULFIDE REGION

POSSIBLE RELATIONSHIP BETWEEN FeO AND FeS ACTIVITIES IN EQUILIBRIUM WITH METALLIC IRON

THE FeO-FeS SYSTEM IN EQUILIBRIUM WITH METALLIC IRON WITH $SO_2$ ISOBARS (W= WUSTITE, P= PYRRHOTITE)

SKETCH OF SAMPLE ARRANGEMENT IN THE MUFFLE FURNACE

FIG. 7
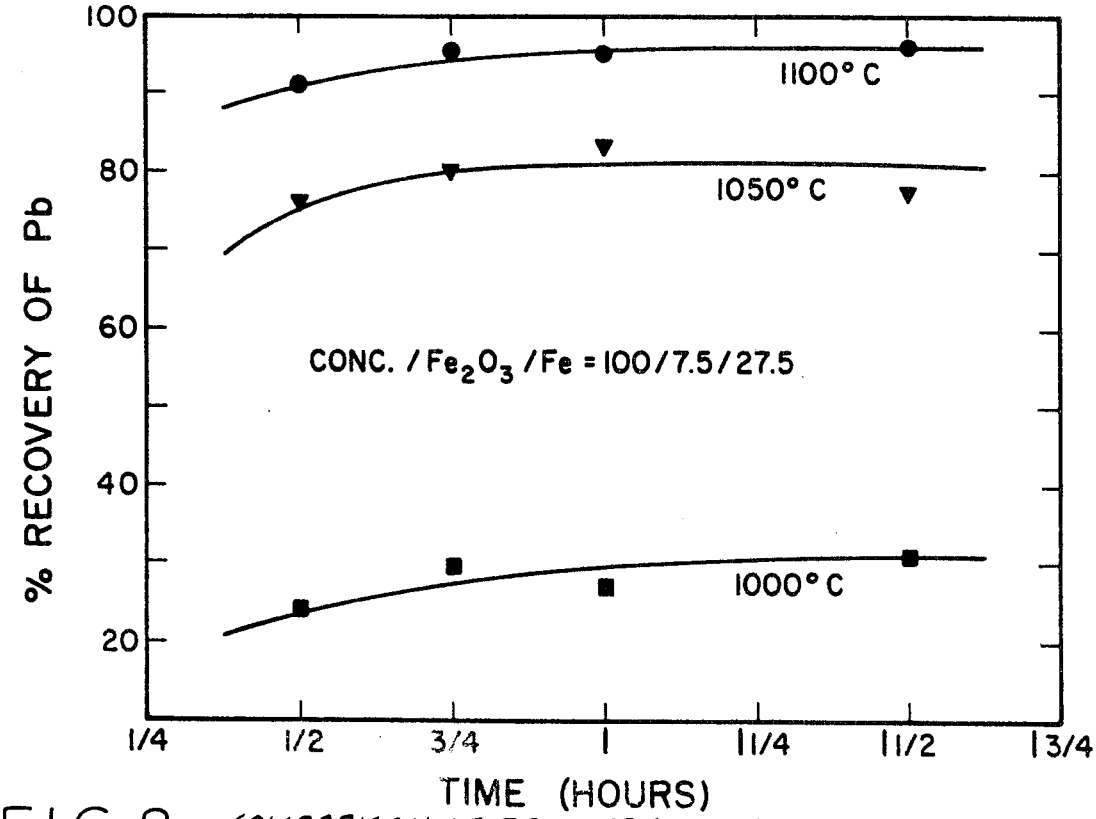
FIG. 8 COMPARISON OF RECOVERY OF LEAD AT DIFFERENT TIMES AND TEMPERATURES
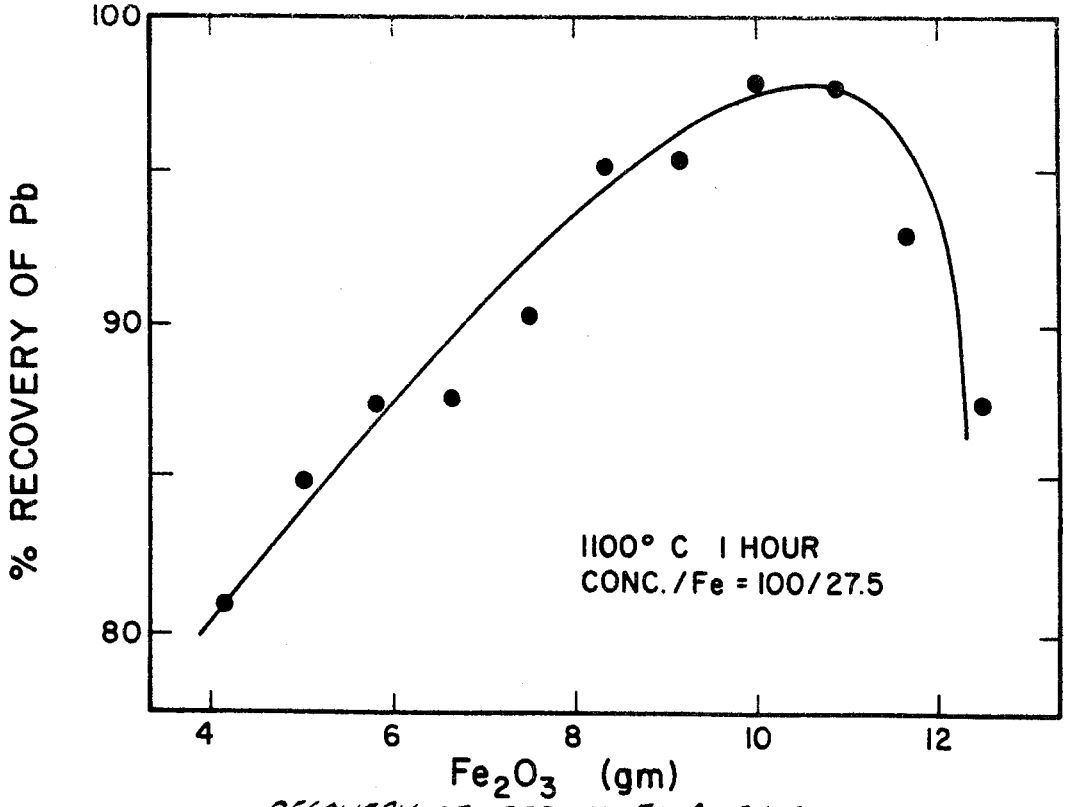
RECOVERY OF LEAD VS $Fe_2O_3$ AS FLUX RECOVERY OF LEAD VS IRON WITH $Fe_2O_3$ AS FLUX COMPARISON OF RECOVERY OF LEAD AT DIFFERENT TIMES WITH $Fe_3O_4$ AS FLUX RECOVERY OF LEAD VS IRON WITH $Fe_3O_4$ AS FLUX RECOVERY OF LEAD VS $Fe_3O_4$ AS FLUX 1100° C ISOTHERMAL SECTION OF THE Fe-O-S SYSTEM (γ = IRON, P = PYRRHOTITE, W = WUSTITE, M = MAGNETITE, L = LIQUID)

RECOVERY OF LEAD VS IRON WITH $PbSO_4$ AS FLUX (INCLUDING PRILLS)

RECOVERY OF LEAD VS $PbSO_4$ AS FLUX (INCLUDING PRILLS)

RECOVERY OF LEAD VS IRON WITH $PbSO_4$ AS FLUX (INCLUDING PRILLS)

SKETCH OF TUBE FURNACE AND SAMPLE ARRANGEMENT

PROCESS FOR RECOVERY OF LEAD FROM LEAD SULFIDE CONCENTRATES

This is a continuation of application Ser. No. 674,836, filed Apr. 8, 1976, now abandoned, which is a continuation of application Ser. No. 575,354, filed May 7, 1975, now abandoned.

BACKGROUND OF THE INVENTION

This invention relates to the field of extractive pyrometallurgy and, more particularly, to an improved method for recovery of lead from lead sulfide ores by reduction with metallic iron.

Conventionally, lead is extracted from lead sulfide (galena) ores by roasting an ore concentrate to form a lead oxide and reducing the lead oxide to molten lead in a blast furnace. The lead sulfide ore is initially concentrated by a flotation process to form a green concentrate, and the green concentrate is charged to a continuous sintering and roasting operation in which it is conveyed along a moving grate and air is passed through the grate to oxidize the PbS. To provide proper support for newly charged green concentrate and adequate porosity of the roasting mass, approximately 70% of the calcined (burned) material leaving the roasting zone must be recycled through the sintering and roasting operation where it serves as a bed on which the green concentrate is charged. The other thirty percent of the calcined product is charged forward to the blast furnace.

The calcine produced by roasting is predominantly lead oxide but also contains appreciable proportions of lead sulfide, lead sulfate and elemental lead. Together with a limestone flux and metallurgical coke, this material is charged to a blast furnace, where the lead oxide is reduced to elemental lead by reaction with carbon monoxide formed from the partial combustion of the coke. The effluent from the lower end of the blast furnace includes molten elemental lead, a slag, and a matte or dross which may be treated for recovery of copper and nickel.

Although reasonably economical and effective for recovery of lead from galena, operation of the conventional roasting process causes severe air pollution problems in the form of sulfur dioxide emissions. In the roasting operation, sulfur dioxide is formed as a by-product of the oxidation of lead sulfide:

$$2PbS + 3O_2 \rightarrow 2PbO + 2SO_2$$

Further amounts of $SO_2$ are generated by the oxidation of other sulfides contained in the concentrate, e.g., Cu, Fe and Zn sulfides. Because at least one mole of sulfur dioxide is formed for each pound atom of lead produced, tonnage volumes of sulfur dioxide are continuously generated in roasting galena concentrates. A portion of this sulfur dioxide can be converted to sulfuric acid in an on-site contact acid plant. Because of the progressive depletion of sulfur from the sinter/roasting bed as it passes to the discharge end of the roasting zone, however, the gas emanating from the downstream end of the roasting zone is too lean for practical conversion to sulfuric acid. Generally, no more than about 60% of the sulfur dioxide generated by roasting can be economically converted to sulfuric acid, and the remainder must be collected by lime scrubbing or other expensive pollution abatement procedures if massive emissions of sulfur dioxide to the atmosphere are to be avoided.

Because the strength of gas passing off the roasting bed not only varies with the position along the length of the bed but also varies with time due to the impossibility of precise control of the roasting operation, operating problems can be encountered with a by-product acid plant. Such problems add to the cost of converting the $SO_2$ to sulfuric acid and raise the risk of further emissions of unconverted $SO_2$ from the acid plant. In such circumstances, the overall $SO_2$ recovery can be significantly less than 60%. When downtime is experienced in the acid plant, moreover, either the roasting operation must be shut down or 100% of the $SO_2$ generated is released to the atmosphere.

As a result of increasing regulatory restrictions on allowable sulfur dioxide emissions, and the consequent need to install and operate ever more elaborate emission control systems, the cost of operating the roasting unit in a conventional lead extraction plant is expected to increase sharply. There is, thus, a need and an opportunity for commercial implementation of processes by which lead may be efficiently recovered from galena ores without significant generation of sulfur dioxide. One process which avoids $SO_2$ generation, and might, therefore, be considered for commercial use, is the so-called salt process, described in Betts U.S. Pat. No. 821,330, in which reduction takes place according to the reactions:

$$Na_2CO_3 + 2C + PbS \rightarrow Pb + Na_2S + 3CO$$

$$Fe_2O_3 + 3C + 2PbS \rightarrow 2Pb + 2FeS + 3CO$$

Pendar U.S. Pat. No. 2,834,669 describes a modification of this process in which NaCl is substituted in part for $Na_2CO_3$ to improve process economics. Since the salt process produces a matte containing $Na_2S$ it presents severe disposal problems and may raise severe corrosion problems as well.

A hydrogen reduction process has also been proposed for lead recovery but this process not only requires relatively large amounts of hydrogen but generates at least a mole of hydrogen sulfide for each pound atom of lead that is produced. In operation of this process, it is necessary to separate the hydrogen sulfide by-product from relatively large volumes of unreacted hydrogen, and to make provision for disposal of the hdyrogen sulfide so separated.

In the 19th century, a process was carried out in Germany in which lead was recovered from lead sulfide ore by direct reduction with metallic iron. This process has been known as the "precipitation" process. As practiced commercially, the precipitation process did not afford high recovery efficiencies and was not competitive with the roasting process where large volumes of ore were handled. Because the precipitation process generally required a lower capital investment than a roasting operation, however, it found favor in locations where the supply of ore was insufficient to justify the capital expenditure required for a more efficient process.

In the precipitation process, the lead sulfide ore and metallic iron were charged to a reverberatory or blast furnace together with coke which was used as a fuel. Although the lead in the ore was directly reduced to the elemental state by reaction with the iron, the sulfur content of the ore was oxidized by air drawn into the furnace and sulfur dioxide was thus generated. The thermodynamics of the process were not well known nor were the conditions under which the sulfur might be retained in the condensed state.

Because of the theoretical potential for the precipitation process to proceed as follows:

$$PbS + Fe \rightarrow Pb^{\circ} + FeS$$

this scheme raises the possibility of commercial recovery of lead from galena without significant $SO_2$ generation. Prior to the present invention, however, the conditions under which the precipitation process could be operated, either for high lead recovery or $SO_2$ suppression, were unknown to the art.

SUMMARY OF THE INVENTION

It is an object of the present invention to provide an improved process by which lead can be directly reduced from lead sulfide ore through reaction with metallic iron. It is a further object of the present invention to provide such a process in which lead may be recovered in high yield from the ore. It is a particular object of the present invention to provide such process in which generation of significant quantities of sulfur dioxide is avoided. Other objects and features will be in part apparent and in part pointed out hereinafter.

Briefly, therefore, the present invention is directed to a process for recovery of lead from a lead sulfide concentrate. In this process, a furnace charge is prepared comprising the concentrate, a source of elemental iron and a source of available oxygen capable of reacting with the sulfur of the concentrate to form an oxysulfide matte. The concentrate, source of elemental iron and source of oxygen are present in such relative proportions that the sum of the elemental iron content and the sulfur-reducible combined iron content of the charge is at least about 1.1 pound atoms per pound atom of sulfur based on the total sulfur content of the charge, and the oxygen source provides between about 0.25 and 0.5 pound atoms available oxygen per pound atom of sulfur based on the total sulfur content of the charge. The charge is heated to a temperature of at least about 1050° C. and maintained at at least 1050° C. to effect reduction of lead sulfide with elemental iron, while limiting access of air to the charge so as to substantially prevent formulation of sulfur dioxide therein. Elemental lead and a matte containing partially oxygenated iron sulfide are thus formed without substantial evolution of sulfur dioxide. The elemental lead is separated from the matte.

BRIEF DESCRIPTION OF THE DRAWINGS

FIG. 7 is a plot of lead recovery against smelting time at various temperatures for the runs of Example 5, infra;

FIG. 8 is a plot of lead recovery against $Fe_2O_3$ charge for the runs of Example 6, infra;

DESCRIPTION OF THE PREFERRED EMBODIMENTS

In accordance with the present invention, it has been discovered that lead may be recovered in high yield from sulfide ores by precipitation with metallic iron in the presence of an oxygen-bearing flux or other oxygen source capable of oxygenating the sulfur to form an oxysulfide matte. If the temperature and proportions of lead sulfide, metallic iron and oxygen-bearing flux are properly controlled, lead recoveries in excess of 90% of theoretical can be realized without the necessity of collecting dust or lead vapors emanating from the reduction furnace. Moreover, control of process conditions, together with substantial exclusion of air from the furnace, effectively prevents the generation of sulfur dioxide or the emanation of any appreciable amounts of off-gas or dust from the reaction zone. Thus, the process of the invention is most advantageously adapted for processing galena ores without the severe sulfur oxide emission problems encountered in operation of the conventional roasting process. The products of the process of the invention are elemental lead, a matte comprising an oxysulfide of iron and a relatively small volume of slag typically containing some of the oxygen-bearing flux together with various calcium magnesium silicates.

An essential feature of the process of the invention is the preparation of a furnace charge containing proper proportions of a source of oxygen capable of reacting with the sulfur of the concentrate in the presence of iron to form an oxysulfide matte. The oxygen source is preferably an oxygen-bearing flux which absorbs the iron sulfide reaction product in the liquid matte and converts at least a portion of the sulfide to an oxysulfide, thus lowering the activity of FeS and driving the lead sulfide reduction reaction to the right:

$$PbS + Fe \rightarrow FeS + Pb$$

Advantageously, the flux is an oxide of iron such as wustite (FeO), hematite ($Fe_2O_3$) or magnetite ($Fe_3O_4$).

Figure 1:
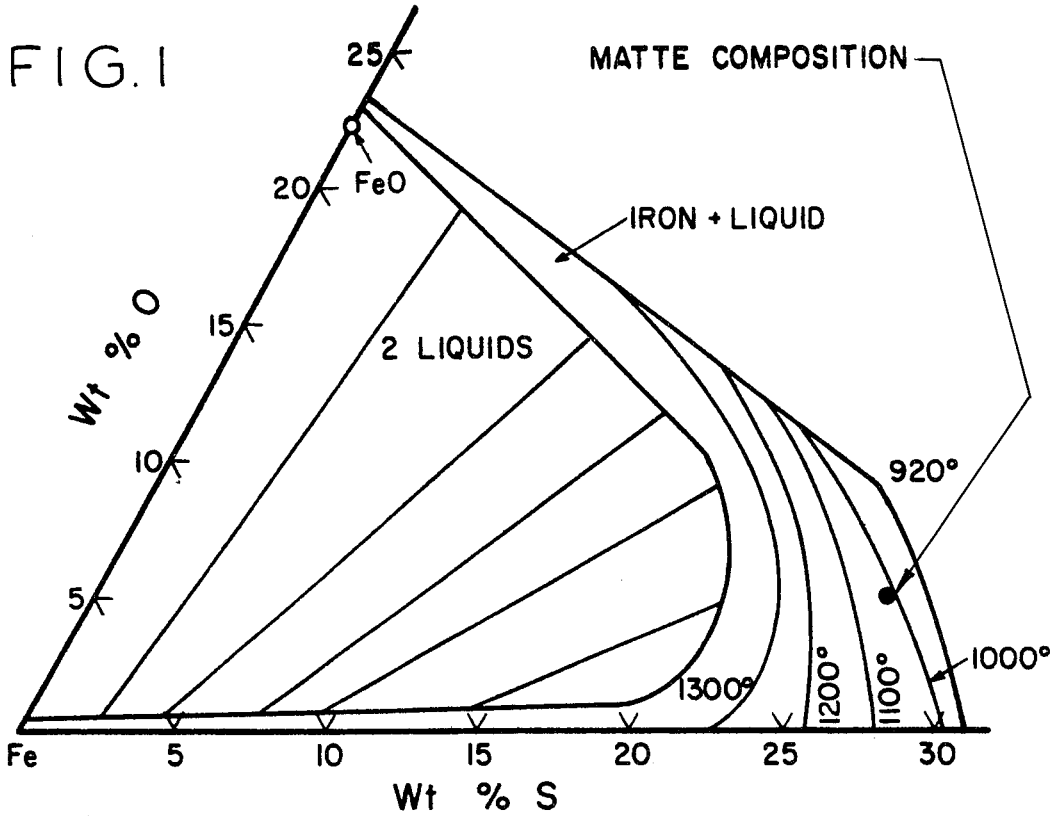
FIG. 1 is a portion of the ternary diagram for the system Fe—O—S that is in equilibrum with metallic iron, based on the diagram of Hilty and Crafts "Liquidus Surface of the Fe—O—S System", *Journal of Metals,* December 1952, pp. 1307–1312.

FIG. 1 is a portion of the Fe—O—S phase diagram which may be utilized to demonstrate the effect of FeO additions on the melting characteristics of an FeS-based matte. Ascending from the ternary eutectic point of about 920° C. are the liquidus contours above which a single phase liquid matte is present. Below these temperature contours, a liquid matte is in equilibrium with solid iron. Analysis of this diagram indicates that addition of oxygen in the form of FeO adjusts the matte composition to one having a lower liquidus and solidus temperature. Although FeO would alter the composition of a single phase system along a line extending to the point on the diagram representing FeO, the actual net effect of FeO addition in the process of the invention is normally to alter the composition of the matte in a direction oriented generally toward the oxygen apex of the diagram. An increase in the FeO charge does not materially increase the Fe content of a matte having a composition within the range depicted since such a matte is saturated with iron, and addition of FeO results only in absorption of oxygen into the matte, with concomitant precipitation of elemental iron. In the presence of PbS, the precipitated iron may be converted to iron sulfide, which is absorbed into matte, but the extent of iron absorption still does not violate the solubility limitations indicated in the phase diagram.

Figure 2:
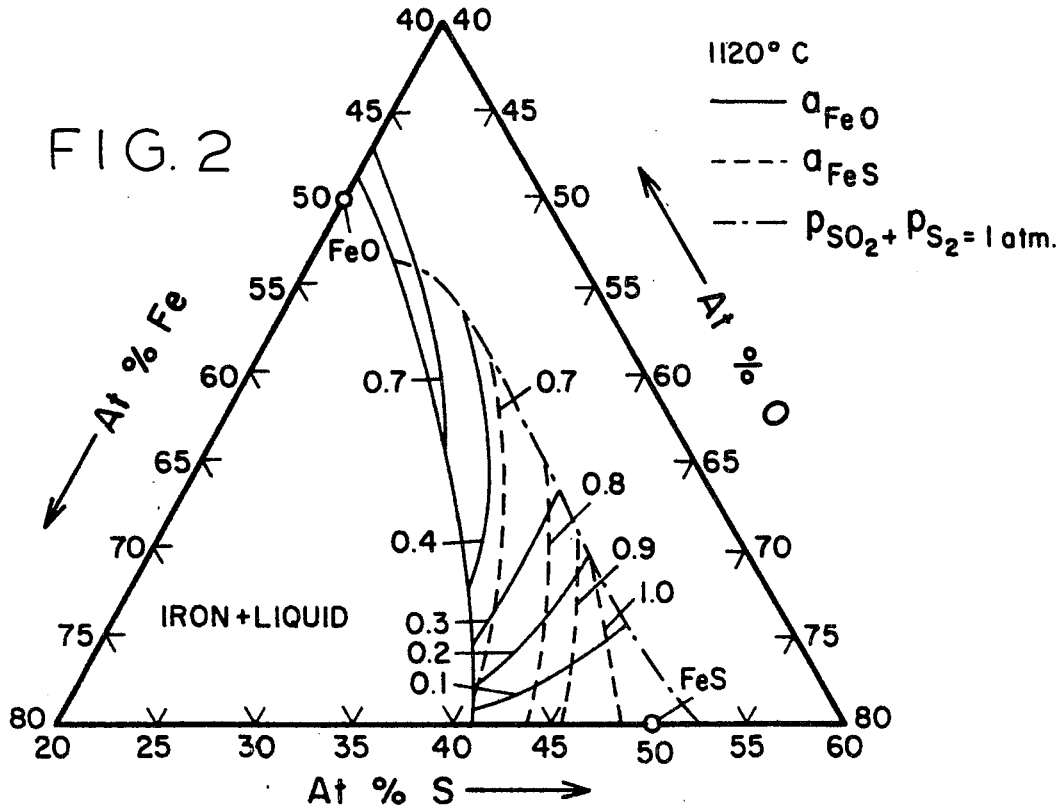
FIG. 2 is a portion of a diagram of an Fe—O—S system bearing contours of constant FeO and FeS activity based on the studies of Bog and Rosenqvist "A Thermodynamic Study of Iron Sulfide-Iron Oxide Melts", *The Physical Chemistry of Metallic Solutions and Intermetallic Compounds,* Paper 6B, NPL Symposium No. 9, London, 1958.
Figure 3:
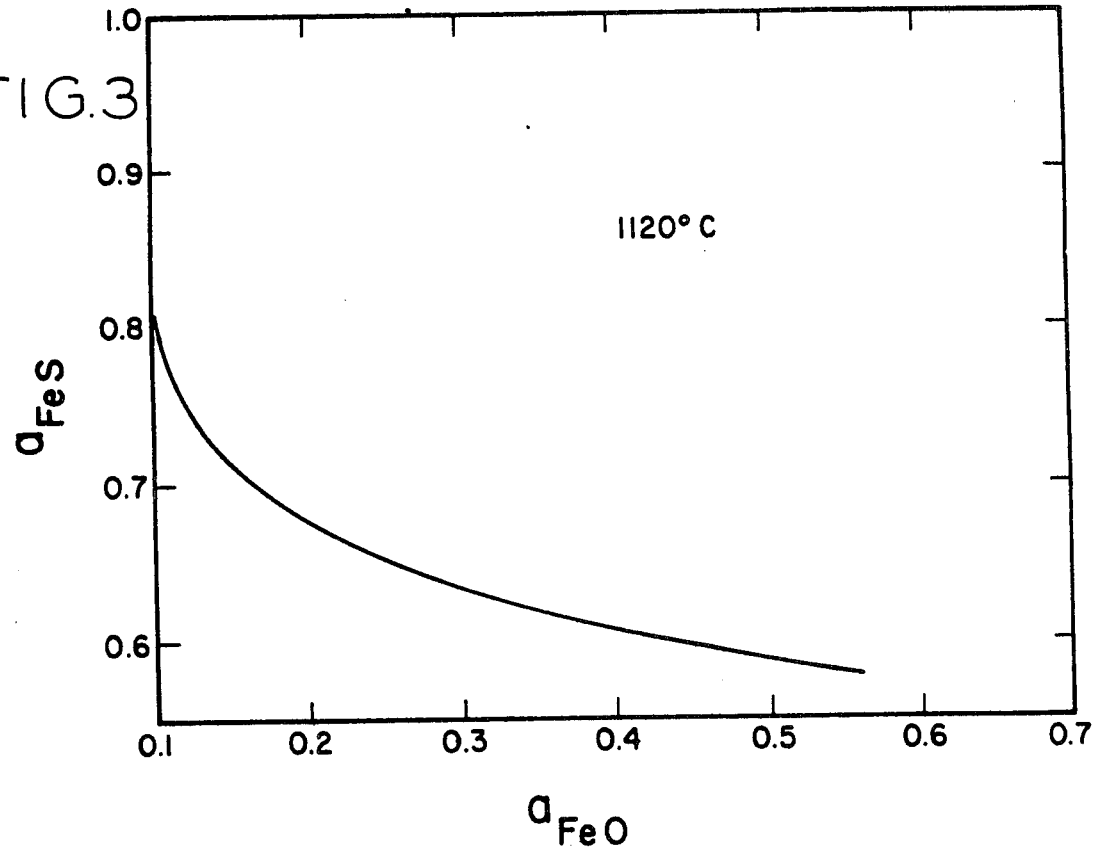
FIG. 3 is a cross-plot of the data of FIG. 2 showing FeS activity as a function of FeO activity at 1,120° C.

In FIG. 2, the loci of several particular activities of FeO and FeS are plotted on the iron saturation region of an iron oxysulfide phase diagram at 1120° C. FIG. 3 is a cross-plot of data taken from FIG. 2 showing the probable relationship between activity of FeS and the activity of FeO at iron saturation. FIG. 3 illustrates the effect of FeO additions in lowering the activity of FeS and thus driving the iron reduction reaction to the right.

Iron oxides are highly useful fluxes in the process of the invention since they constitute sources of both oxygen and iron. Basic oxygen furnace flue dust is an especially attractive flux which contains both iron oxides and metallic iron. Although oxides of iron are particularly preferred, a variety of other oxygen-bearing fluxes compatible with the process may be used as the oxygen source in the process of the invention. Because the function of the oxygen-bearing compound is to provide a source of oxygen which combines or associates with sulfur in the matte to form an oxysulfate and thereby reduce the activity of FeS, highly stable oxygen-bearing compounds, such as aluminum oxide, are not suitable or compatible fluxes for the process of the invention. Excessively caustic fluxes, which are corrosive to the refractory, high melting fluxes, and those which are highly volatile are also preferably avoided. In addition to the oxides of iron, lead sulfate, for example, derived from battery scrap, lead oxides, and basic lead sulfates ($PbSO_4.PbO$; $PbSO_4.2PbO$; $PbSO_4.4PbO$) may be commercially suitable fluxes. Iron sulfate, iron nitrate and lead nitrate also afford useful sources of available oxygen. Although less preferred, the oxides, sulfates and nitrates of certain other metals may be used as oxygen sources in the process of the invention. Thus, the higher oxides of manganese ($Mn_2O_3$, $MnO_2$, $Mn_3O_4$), manganese sulfate, copper oxide and copper sulfate can be substituted in part for the more preferred oxygen sources.

It has been found that the proportion of the oxygen source present in the reaction zone has an important bearing on the recovery of lead. An optimum exists above which and below which lead recovery is less than the maximum attainable. Generally, it has been discovered that the charge should contain a proportion of the oxygen source sufficient to provide between about 0.25 and 0.5 pound atoms available oxygen per pound atom of sulfur, based on the total sulfur content of the smelting furnance charge. The total sulfur content includes sulfur from all sources, whether associated with Pb or other metals contained in the concentrate, or derived from the flux (e.g., $PbSO_4$) or the source of elemental iron. By available oxygen is meant that portion of the oxygen content of the oxygen source which is reactive with the sulfur of the concentrate to form the oxysulfide matte. In the case of the oxides, nitrates and sulfates or iron and lead, all of the oxygens are available for reaction with the sulfur of the matte. In the case of the oxides of manganese, however, only the oxygen above MnO is available for reaction with the sulfide. In determining the available oxygen content of the furnace charge, it is necessary to make a correction for the oxygen equivalent of contaminants such as carbon which are reactive with oxygen and remove it from the matte. Thus, as used herein, the amount of "available oxygen" is the difference between the total amount of oxygen which would be reactive with sulfur in the absence of such contaminants and the amount of oxygen equivalent to the contaminants.

To achieve maximum recovery of lead, it is also essential that the metallic iron content of the furnace charge be sufficient to provide an excess of iron over sulfur in the charge. It has been discovered that lead recoveries well in excess of 90% can be realized with the above-noted optimum proportions of oxygen-bearing flux, and a proportion of a source of solid metallic iron such that the sum of the elemental iron and sulfur-reducible combined iron content of the charge is at least about 1.1 pound atoms per pound atom of sulfur, based on the total sulfur content of the charge. Sulfur-reducible combined iron is that which is reduced to elemental iron on reaction with the sulfur of the concentrate or the matte. Thus, for example, the iron content of iron oxide charged as an oxygen source is combined iron reducible by sulfur to form elemental iron, and is thus includable in determining the aforesaid sum. Any sulfur-reducible combined iron in the concentrate should also be included in determining the proportion of the elemental iron source required to provide 1.1 or more pound atoms of elemental and sulfur-reducible combined iron per pound atom of sulfur in the charge.

Where finely divided iron is used as the source of metallic iron and $Fe_2O_3$, $Fe_3O_4$ or $PbSO_4$ is used alone as the flux, it has been observed that an optimum iron charge exists, above which and below which the recovery of lead falls off. It is believed that in such circumstances too much iron adversely affects separation of entrained lead from the matte phase. Where powdered or finely comminuted iron is used as the fluxing agent, therefore, it is generally preferred that the sum of the elemental iron and sulfur-reducible iron content of the charge not exceed about 1.5 pound atoms per pound atom of sulfur based on the total sulfur content of the charge. Such limitation also avoids excessive iron consumption in the operation of the process. Where higher proportions of iron are used, lead yields and iron usages may be improved somewhat by recovery of these materials from the matte, for example, by allowing the matte to solidify, crushing it, and screening or classifying it to recover lead and iron from it. To achieve optimum yields with a minimum of auxiliary processing, however, the above-noted limitations on the iron content of the charge should be observed where the source of iron is charged in finely divided form.

Because of the relatively high surface area provided, iron powder and relatively finely comminuted scrap material represent preferred sources of elemental iron. Particularly suitable are those scrap materials initially available in a subdivided state such as, for example, machine cuttings and borings. As indicated, another suitable source of elemental iron is steel mill flue dust. Such flue dust may contain appreciable proportions of zinc, but the presence of zinc does not interfere with the effectiveness of the flue dust as a reducing agent for lead sulfide. In fact, the zinc may serve to a limited extent as an auxiliary reducing agent.

Utilizing the above-noted optimum furnace charges and carrying out the reduction reaction in a reaction zone from which ambient air is substantially excluded, the process of the invention provides high lead recoveries with minimum generation of sulfur dioxide. Since oxygen is a necessary and critical component of the furnace charge, it will be understood that absolute exclusion of air is not required. If substantially quantities of air are allowed to enter the reaction zone, on the other hand, the matte will become excessively oxidized and its sulfur dioxide vapor pressure will increase until, ultimately, $SO_2$ off-gas generation may ensue. Substantial exclusion of air is, therefore, a practical requirement for operation of the process of the invention.

In order to avoid sulfur dioxide generation, it is also necessary to limit the oxygen-bearing flux content of the charge to prevent excess oxygenation of the matte. In practice, however, the proportion of oxygen-bearing flux which can be tolerated without sulfur dioxide generation is sustantially higher than the levels beyond which lead recovery falls off sharply from optimum. Thus, lead recovery, not sulfur dioxide generation, is controlling in determining the optimum range of flux content of the furnace charge.

Figure 4:
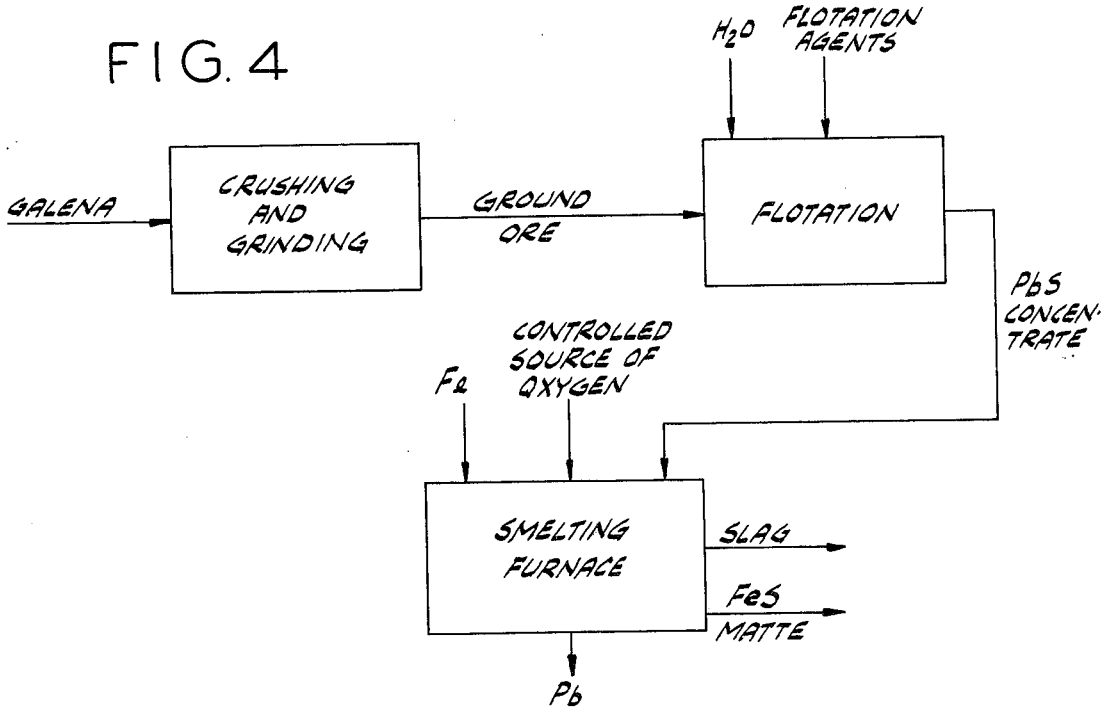
FIG. 4 is a flow sheet setting forth the sequence of operations in the process of the invention.

FIG. 4 is a flow sheet which illustrates the operation of the process of the invention. Lead ore (galena) is subjected to conventional crushing, grinding and flotation operations to provide a concentrate for charging to the smelting furnace. In a preferred embodiment of the invention, a closed electric furnace is used for the smelting reaction. This furnace may be provided with a blanket of an inert gas such as nitrogen, though this is generally unnecessary since the minor amounts of gas produced on heating the charge are usually sufficient to drive out air from the furnace and protect the charge against overoxidation. A particularly suitable furnace is a closed furnace having an external circulating line (or sidearm). In such a furnace, heat is applied to the lead by an induction coil surrounding the sidearm and this coil also pumps the lead through the circulating line and back into the furnace. Lead cascading back into the furnace gives up its sensible heat to the charge. A submerged arc electric furnace is also suitable if an adequate head of material is maintained over the arc in order to avoid dust generation.

The lead concentrate is charged to the furnace together with the flux and source of metallic iron. Metallic iron remains in the solid state at the temperatures at which the reduction reaction is preferably carried out, and it is for this reason that the elemental iron charge should be in a subdivided state, for example, in the form of powder or pellets. The lead concentrate is advantageously dried to remove excess free water before charging to the furnace.

Figure 5:
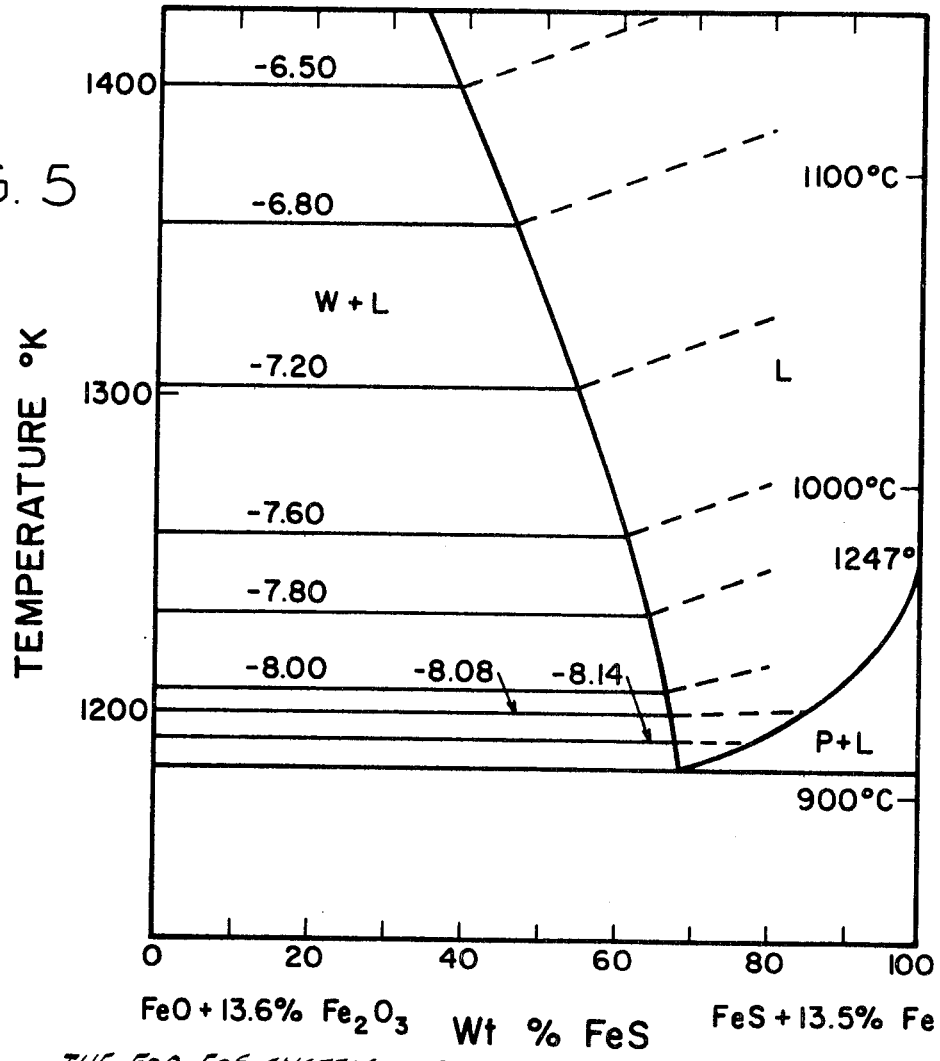
FIG. 5 is a phase diagram for the system iron oxide/iron sulfide in equilibrium with metallic iron on which are plotted the isobars of $P_{SO_2}$ calculated from the data of Turkdogan and Kor "Sulfides and Oxides in Fe—Mn Alloys: Part I. Phase Relations in Fe—Mn—S—O System", *Met. Trans.* Vol. 2, June 1971, pp. 1561–1570.

The reduction reaction is carried out at a temperature of at least 1050° C. Although temperatures up to 1400° C. or higher may be utilized, the reduction reaction is preferably carried out at a temperature of about 1150° C. in a batch operation. Higher temperatures afford a more favorable equilibrium and promote higher reaction rates but the vapor pressure of lead reaches 0.1 atm at 1400°. Excessively rapid refractory wear may also limit the use of very high temperatures. If air is effectively excluded and the reacted equivalent of the above-noted charge ratios are maintained throughout the reaction, sulfur dioxide vapor pressure remains very low, even at temperatures above 1100° C. FIG. 5, shows the $SO_2$ isobars over an iron oxide/iron sulfide/iron system. Extrapolation of this data indicates that the sulfur dioxide vapor pressure remains practically negligible at temperatures up to 1400° C. or higher.

Where the refractory wear problem is economically tolerable or satisfactorily controlled, the data of FIG. 5 demonstrates the practicability of operations at highly elevated temperatures. If the process is carried out in an electric furnace, there is essentially no gaseous effluent from the reaction zone so that the relatively high partial pressures of lead reached over the reaction zone at high temperatures can be tolerated without significant losses of lead from the furnace.

At temperatures of 1100° C. or higher, the reduction reaction proceeds to completion in approximately 1 – 1½ hrs. At the end of the reaction period, the product molten lead bullion, matte and slag are removed from the reaction zone and separated. The bullion may be treated by conventional purification processes for desilverizing. If the iron reduction reaction is carefully controlled, however, copper, zinc, nickel and other metals of higher affinity for sulfur than iron are concentrated in the matte. Thus, conventional decopperizing and dezincing operations may not be necessary.

Where the concentrate contains significant proportions of copper, nickel or zinc, these metals may be recoverable from the matte. Conventional procedures for processing the matte to separate the sulfides of the aforesaid metals from iron sulfide can be utilized for this purpose.

Because the process of the invention can be operated to avoid any significant generation of off-gas, the bulky and expensive dust handling equipment required for a conventional lead recovery process may be entirely avoided. Substantial capital savings are realized not only from the elimination of dust and gas handling equipment but also from the substitution of a single condensed phase iron reduction reaction for the two-step roasting and blast furnace operation required in the conventional process. Further advantages accrue with respect to safety of operation since there are neither sulfur dioxide nor toxic metal fumes to be dealt with. As indicated above, moreover, the process functions quite satisfactorily on otherwise undesirable scrap iron, such as steel mill flue dust, which may be contaminated with copper and zinc. The process of the invention is thus capable of consuming solid waste products which are now dumped or stockpiled.

The following examples illustrate the invention:

EXAMPLE 1

Direct reduction of lead sulfide concentrates was carried out in a muffle furnace heated by silicon carbide elements. The furnace temperature was controlled using a millivolt pyrometer and chromel-alumel thermocouple. A series of runs were made in which a Missouri lead sulfide conentrate having a lead content of 75.0% by weight was reduced using iron powder. In each run, the ratio of concentrate to iron was 100:25.2 and the smelting temperature was 1200° C. No flux was used. In order to keep air from contacting the charge, the charge was contained within a fireclay crucible placed within the furnace. The compositions of the charges, and the weight and percentage recovery of lead for the runs of this example are set forth in Table I.

TABLE I

| Test | Weight Conc. gm | Weight Fe gm | Weight Pb recovered gm | Recovery (%) |
|---|---|---|---|---|
| 1-1 | 250.0 | 63.0 | 102.3 | 54.6 |
| 1-2 | 250.0 | 63.0 | 135.7 | 72.4 |
| 1-3 | 250.0 | 63.0 | 105.1 | 56.0 |
| 1-4 | 250.0 | 63.0 | — | — |
| 1-5 | 202.1 | 51.4 | 64.0 | 42.3 |
| 1-6 | 203.2 | 51.4 | 82.0 | 53.8 |
| 1-7 | 203.5 | 51.5 | 84.0 | 54.9 |
| 1-8 | 167.7 | 42.3 | 73.0 | 58.1 |

EXAMPLE 2

Direct smelting of a lead concentrate was carried out in the manner generally described in Example 1, except that $Fe_2O_3$ was introduced as a flux. The compositions of the charges, and the weight and percentage recovery of lead for the runs of this example are set forth in Table II.

TABLE II

| Test | Weight Conc. gm | Weight Fe gm | Weight $Fe_2O_3$ gm | Weight Pb recovered gm | Recovery Pb % |
|---|---|---|---|---|---|
| 2-1 | 159.8 | 40.2 | 10.0 | 97.5 | 81.3 |
| 2-2 | 159.8 | 40.2 | 20.0 | 81.0 | 67.5 |
| 2-3 | 166.7 | 33.3 | 10.0 | 91.5 | 73.2 |
| 2-4 | 160.0 | 40.0 | 10.0 | 100.0 | 84.4 |
| 2-5 | 151.5 | 48.5 | 10.0 | 98.1 | 86.4 |
| 2-6 | 161.3 | 38.7 | 10.0 | 98.8 | 82.3 |
| 2-7 | 156.3 | 43.7 | 10.0 | 104.0 | 89.0 |
| 2-8 | 147.2 | 52.8 | 10.0 | 92.5 | 83.7 |
| 2-9 | 160.0 | 44.8 | 8.0 | 92.3 | 76.7 |
| 2-10 | 160.0 | 44.8 | 12.0 | 96.3 | 80.3 |
| 2-11 | 160.0 | 51.2 | 8.0 | 88.5 | 78.3 |
| 2-12 | 160.0 | 40.0 | 10.0 | 101.3 | 84.5 |
| 2-13 | 160.0 | 45.0 | 10.0 | 104.3 | 87.0 |
| 2-14 | 160.0 | 50.0 | 10.0 | 104.3 | 87.0 |

EXAMPLE 3

A series of direct smelting runs were conducted using a basic oxygen furnace flue dust as the flux and iron powder as the source of elemental iron. The analyses of the concentrate and flux utilized in the runs of this example are set forth below.

| Elements | Analysis of Concentrate Wt. % | Elements | Wt. % |
|---|---|---|---|
| Pb | 75 | $SiO_2$ | 0.24 |
| S | 14.7 | CaO | 1.8 |

-continued

| Elements | Analysis of Concentrate Wt. % | Elements | Wt. % |
|---|---|---|---|
| Fe | 2.95 | MgO | 0.71 |
| Cu | 1.9 | Ni | 0.13 |
| Zn | 1.7 | Co | 0.10 |

| Elements | Analysis of BOF Flue Dust Wt. % | Elements | Wt. % |
|---|---|---|---|
| $Fe^{+3}$ | 21.2 | Cr | 0.02 |
| $Fe^{+2}$* | 34.5 | Al | 0.80 |
| Zn (total) | 6.34 | Na | 0.20 |
| Zn (as oxide) | 5.71 | Mg | 0.30 |
| Zn (as ferrite) | 0.63 | Ca | 3.76 |
| Pb | 0.44 | Si | 2.23 |
| Cu | 0.33 | C | 0.44 |
| Mn | 0.54 | P | 0.10 |
| Ni | 0.02 | S | 0.11 |

*Includes both elemental iron and ferrous iron contained in the dust

Each of the runs of this example was carried out in a small Coors porcelain crucible placed in a furnace of the type described in Example 1. The charge for each run contained 60 g of concentrate with the iron powder content of the charge varying from 10–25 g and the flue dust content varying from 3–21 g. Reaction was carried out at 1200° C. for ½ hr. The compositions of the charges and the lead yield for the runs of this example are set forth in Table XIX.

TABLE III

| Test | Weight Conc. gm | Weight Fe gm | Weight Flue Dust gm | Weight Pb Recovered gm | Recovery Pb % |
|---|---|---|---|---|---|
| 3-1 | 60 | 10.0 | 13.0 | 27.4 | 60.9 |
| 3-2 | 60 | 10.0 | 15.0 | 27.5 | 61.2 |
| 3-3 | 60 | 10.0 | 17.0 | 25.9 | 57.5 |
| 3-4 | 60 | 15.0 | 3.0 | 38.0 | 84.4 |
| 3-5 | 60 | 15.0 | 5.0 | 38.0 | 84.4 |
| 3-6 | 60 | 15.0 | 7.0 | 39.2 | 87.1 |
| 3-7 | 60 | 15.0 | 11.0 | 40.2 | 89.3 |
| 3-8 | 60 | 15.0 | 13.0 | 40.2 | 89.3 |
| 3-9 | 60 | 20.0 | 3.0 | 39.2 | 87.1 |
| 3-10 | 60 | 20.0 | 5.0 | 40.1 | 89.2 |
| 3-11 | 60 | 20.0 | 7.0 | 40.8 | 90.6 |
| 3-12 | 60 | 20.0 | 11.0 | 41.3 | 91.8 |
| 3-13 | 60 | 20.0 | 13.0 | 41.7 | 92.6 |
| 3-14 | 60 | 20.0 | 15.0 | 41.6 | 92.1 |
| 3-15 | 60 | 20.0 | 17.0 | 42.1 | 93.6 |
| 3-16 | 60 | 20.0 | 19.0 | 42.0 | 93.4 |
| 3-17 | 60 | 20.0 | 21.0 | 41.7 | 92.5 |
| 3-18 | 60 | 25.0 | 5.0 | 33.1 | 73.4 |
| 3-19 | 60 | 25.0 | 9.0 | 37.6 | 83.6 |
| 3-20 | 60 | 25.0 | 13.0 | 31.8 | 71.7 |
| 3-21 | 60 | 25.0 | 15.0 | 34.2 | 76.7 |

EXAMPLE 4

A series of direct smelting runs were carried out using the muffle furnace described in Example 1. The charge was contained in a system of the type depicted in FIG. 6. This drawing shows a reactant charge sample 1 contained within an iron crucible 3 having an iron lid 5. Iron crucible 3 is in turn contained within a fireclay crucible 7. A cardboard spacer 9 is inserted between the outside bottom of crucible 3 and the inside bottom of crucible 7. A charcoal sealing barrier 11 is poured over iron lid 5, a second iron lid 13 is placed over barrier 11, and a further charcoal barrier 15 is poured over iron lid 13. The crucible is closed with a fireclay lid 17.

In certain runs of this example, a charge ratio of 100 parts by weight concentrate to 30 parts by weight iron powder was used, and, in other runs, a weight ratio of 100 parts by weight concentrate to 28.9 parts by weight iron powder was used. In the first six runs, magnetite alone was used as the flux, while in the last four runs both magnetite and silica were used. Smelting was conducted at a temperature of 1050° C. for 45 min. The compositions of the reactant charges and the weight and percentage recovery of lead for these runs are set forth in Table IV.

TABLE IV

| Test | Weight Fe gm | Weight $Fe_3O_4$ gm | Weight $SiO_2$ gm | Weight Pb recovered gm | Recovery Pb % |
|---|---|---|---|---|---|
| 4-1 | 30 | 4.0 | — | 18.6 | 82.4 |
| 4-2 | 30 | 6.0 | — | 16.6 | 73.8 |
| 4-3 | 30 | 4.0 | — | 25.7 | 77.0 |
| 4-4 | 28.9 | 5.0 | — | 22.6 | 67.0 |
| 4-5 | 28.9 | 6.0 | — | 21.6 | 64.0 |
| 4-6 | 28.9 | 7.0 | — | 21.2 | 62.8 |
| 4-7 | 28.9 | 3.0 | 1.0 | 21.3 | 63.1 |
| 4-8 | 28.9 | 3.0 | 2.0 | 23.7 | 70.6 |
| 4-9 | 28.9 | 4.0 | 1.0 | 21.8 | 64.6 |
| 4-10 | 28.9 | 4.0 | 2.0 | 23.2 | 68.9 |

EXAMPLE 5

Using the system described in Example 4, direct smelting runs were carried out on a Missouri lead concentrate having the following composition:

| Component | Wt. % |
|---|---|
| Pb | 74.20 |
| Zn | 1.70 |
| Cu | 1.69 |
| Fe | 2.60 |
| S | 15.60 |
| CaO | 1.00 |
| MgO | 0.40 |
| $SiO_2$ | 0.30 |

In order to minimize a tendency for the charge to swell and overflow the crucible, a tendency which was observed in certain of the runs of Examples 1–4, the concentrate used in the runs of this example was washed with acetone in an ultrasonic cleaner for 2 hrs., washed again with methyl ethyl ketone in an ultrasonic cleaner for 2 hrs., and dried by heating in a vacuum over for 8 hrs. at 180° C., prior to introduction into the smelting crucible.

A series of smelting runs were made on charges containing 40 g of concentrate, 3 g of $Fe_2O_3$ as a flux, and 11 g of iron powder. This corresponded to a concentrate $Fe_2O_3$/Fe ratio of 100/7.5/27.5. In each run, each component of the charge was weighed out to an accuracy of ±0.02 g, and the components were then blended, poured into an empty bottle and shaken for 5 min. in order to assure thorough distribution of all charge materials and consequent uniformity of the charge. The charge mixture was then put in an iron crucible of the above-described type having a capacity of 25 cc or 30 cc, and the crucible was tapped on a table to settle its contents. After the iron crucible was placed in a larger fire-clay crucible, as described in Example 1, the covered fire-clay crucible was placed in a muffle furnace and heated. In the runs of this example, the temperature was varied between 1000° and 1100° C. and the smelting time was varied between ½ and 1½ hrs. Various combinations of time and temperature were utilized. The reaction conditions, and the weight and percent recovery of lead for the runs of this example are set forth in Table V. In FIG. 7, the lead recovery is plotted as a function of smelting time at each temperature.

TABLE V

| Test | Time Hours | Temp. ° C | Weight Pb Recovered gm | Recovery % |
|---|---|---|---|---|
| 5-1 | ½ | 1000 | 7.1 | 24.0 |
| 5-2 | ¾ | 1000 | 8.7 | 29.4 |
| 5-3 | 1 | 1000 | 8.3 | 27.9 |
| 5-4 | 1½ | 1000 | 9.1 | 30.5 |
| 5-5 | ½ | 1050 | 22.6 | 76.2 |
| 5-6 | ¾ | 1050 | 23.4 | 78.9 |
| 5-7 | 1 | 1050 | 24.6 | 83.0 |
| 5-8 | 1½ | 1050 | 23.0 | 77.6 |
| 5-9 | ½ | 1100 | 26.8 | 90.8 |
| 5-10 | ¾ | 1100 | 28.4 | 95.6 |
| 5-11 | 1 | 1100 | 28.2 | 95.2 |
| 5-12 | 1½ | 1100 | 28.6 | 96.3 |

These runs indicate that the charge is incompletely melted at a temperature of 1000° C. and that a temperature of at least about 1050° C. is necessary for reasonable conversions. A reduction temperature of 1100° C. provided significantly superior results as compared to 1050° C., and 1100° C. was used as the reaction temperature in subsequent runs.

EXAMPLE 6

Direct smelting tests were carried out in the manner generally described in Example 5, except that the charge in each run of this example contained 60 g of concentrate and 16.5 g of iron. The temperature was held at 1100° C. for 1 hr. in each run, while the proportion of $Fe_2O_3$ flux was varied from run to run. The $Fe_2O_3$ content of the charge, and the weight and percentage of recovery of lead for the runs of this example are set forth in Table VI.

TABLE VI

| Test | Weight $Fe_2O_3$ gm | Weight Pb Recovery gm | Recovery Pb % |
|---|---|---|---|
| 6-1 | 2.0 | 38.9 | 87.6 |
| 6-2 | 2.5 | 36.0 | 81.0 |
| 6-3 | 3.0 | 37.8 | 85.5 |
| 6-4 | 3.5 | 38.9 | 87.6 |
| 6-5 | 4.0 | 39.1 | 87.8 |
| 6-6 | 4.5 | 40.2 | 90.4 |
| 6-7 | 5.0 | 42.4 | 95.4 |
| 6-8 | 5.5 | 42.4 | 95.4 |
| 6-9 | 6.0 | 43.6 | 98.1 |
| 6-10 | 6.5 | 43.3 | 97.1 |

In FIG. 8, the percentage of recovery of lead is plotted against the $Fe_2O_3$ content of the furnace charge.

EXAMPLE 7

Figure 9:
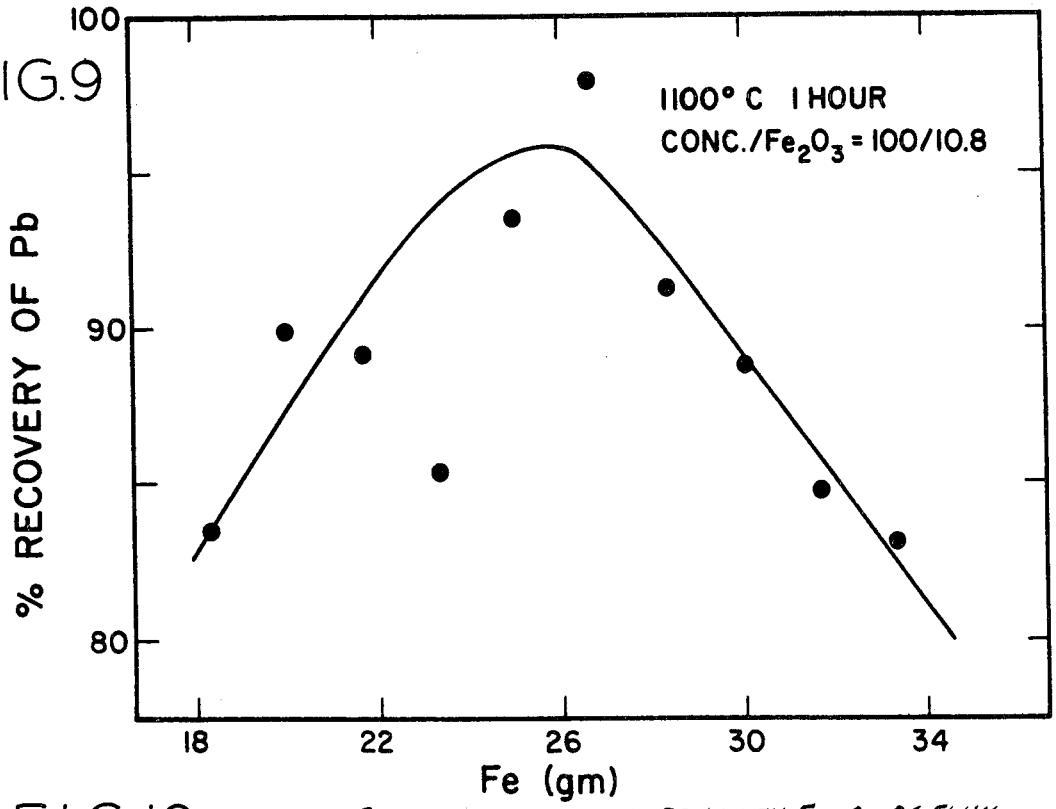
FIG. 9 is a plot of lead recovery against Fe charge for the runs of Example 7, infra.

Direct smelting of a lead concentrate was carried out in the manner described in Example 6, except that the iron charge was varied while the lead concentrate and $Fe_2O_3$ charges were maintained at a fixed ratio of 100:10.8, the approximate ratio indicated by the results of Example 6 to provide a maximum recovery of lead. The charge in each run thus contained 60 g of the lead concentrate and 6.5 g of $Fe_2O_3$. The iron content of the charge, and the weight and percentage recovery of lead for the runs of this example are set forth in Table VII, and the percentage recovery of lead is plotted against the iron content of the charge in FIG. 9.

TABLE VII

| Test | Weight Fe gm | Weight Pb Recovered gm | Recovery Pb % |
|---|---|---|---|
| 7-1 | 11.0 | 37.2 | 83.7 |
| 7-2 | 12.0 | 39.8 | 90.0 |
| 7-3 | 13.0 | 39.6 | 89.1 |
| 7-4 | 14.0 | 38.0 | 85.5 |

TABLE VII-continued

| Test | Weight Fe gm | Weight Pb Recovered gm | Recovery Pb % |
|---|---|---|---|
| 7-5 | 15.0 | 41.6 | 93.7 |
| 7-6 | 16.0 | 43.7 | 98.1 |
| 7-7 | 17.0 | 40.6 | 91.4 |
| 7-8 | 18.0 | 39.4 | 88.7 |
| 7-9 | 19.0 | 37.7 | 84.8 |
| 7-10 | 20.0 | 35.9 | 80.8 |

EXAMPLE 8

Figure 6:
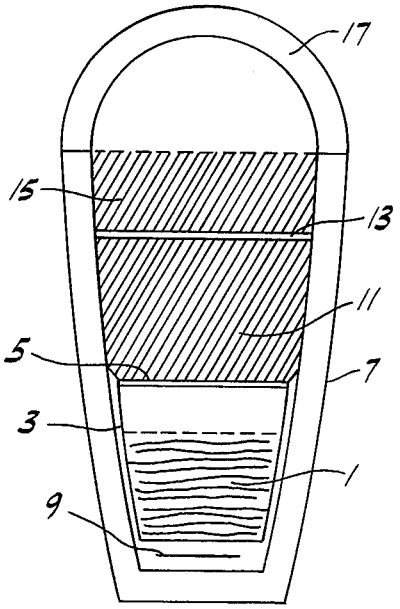
FIG. 6 is a sketch of a system for containing a furnace charge used in carrying out the process of the invention.
Figure 10:
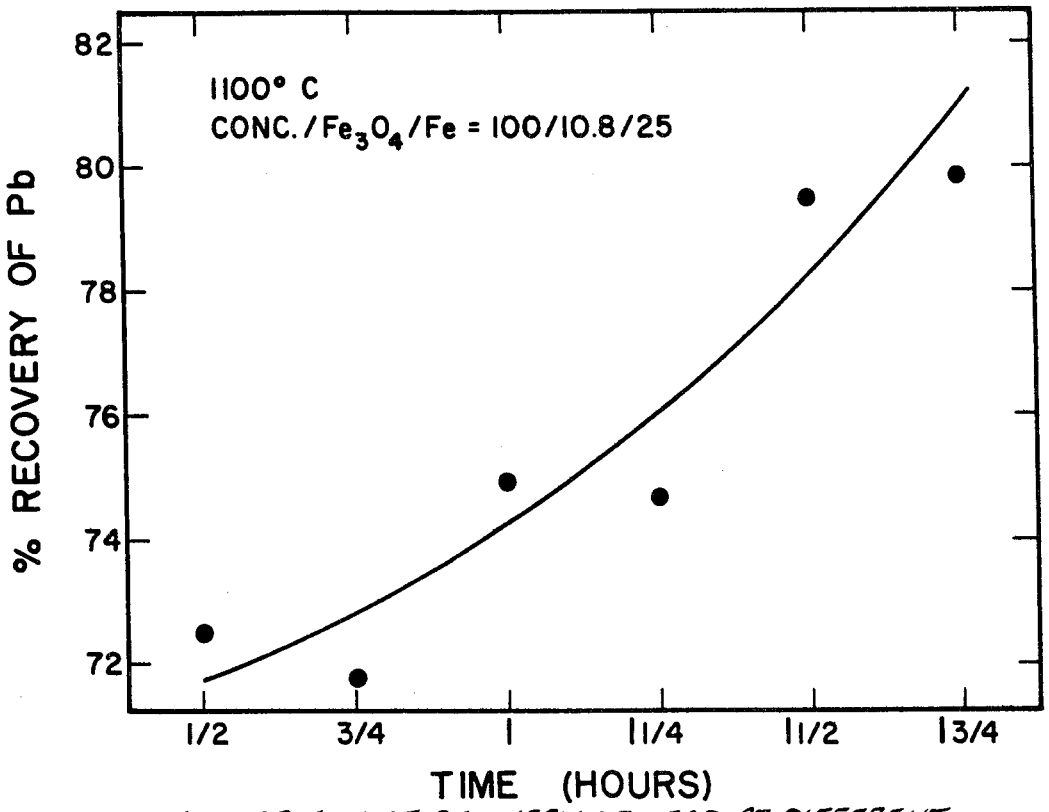
FIG. 10 is plot of lead recovery against smelting time for the runs of Example 8, infra.

Using the dual crucible arrangement illustrated in FIG. 6, direct smelting runs were carried out on a lead concentrate of the type referred to in Example 5. In each of these runs, $Fe_3O_4$ (magnetite) was utilized as the flux, and the crucible was charged with lead concentrate, magnetite and powdered iron in the ratio of 100:10.8:25. Each charge contained 40 g of the concentrate and 10 g of the powdered iron. Reaction was carried out at 1100° C. for periods ranging from ½ – 1¾ hrs. The reaction period and the weight and percentage recovery of lead in these runs are set forth in Table VIII, and the percentage recovery of lead is plotted against the reaction time in FIG. 10.

TABLE VIII

| Test | Time hours | Weight Pb Recovered gm | Recovery Pb % |
|---|---|---|---|
| 8-1 | ½ | 21.1 | 71.3 |
| 8-2 | ¾ | 20.9 | 70.5 |
| 8-3 | 1 | 22.2 | 74.9 |
| 8-4 | 1¼ | 22.1 | 74.7 |
| 8-5 | 1½ | 23.6 | 79.6 |
| 8-6 | 1¾ | 23.6 | 79.6 |

EXAMPLE 9

Figure 11:
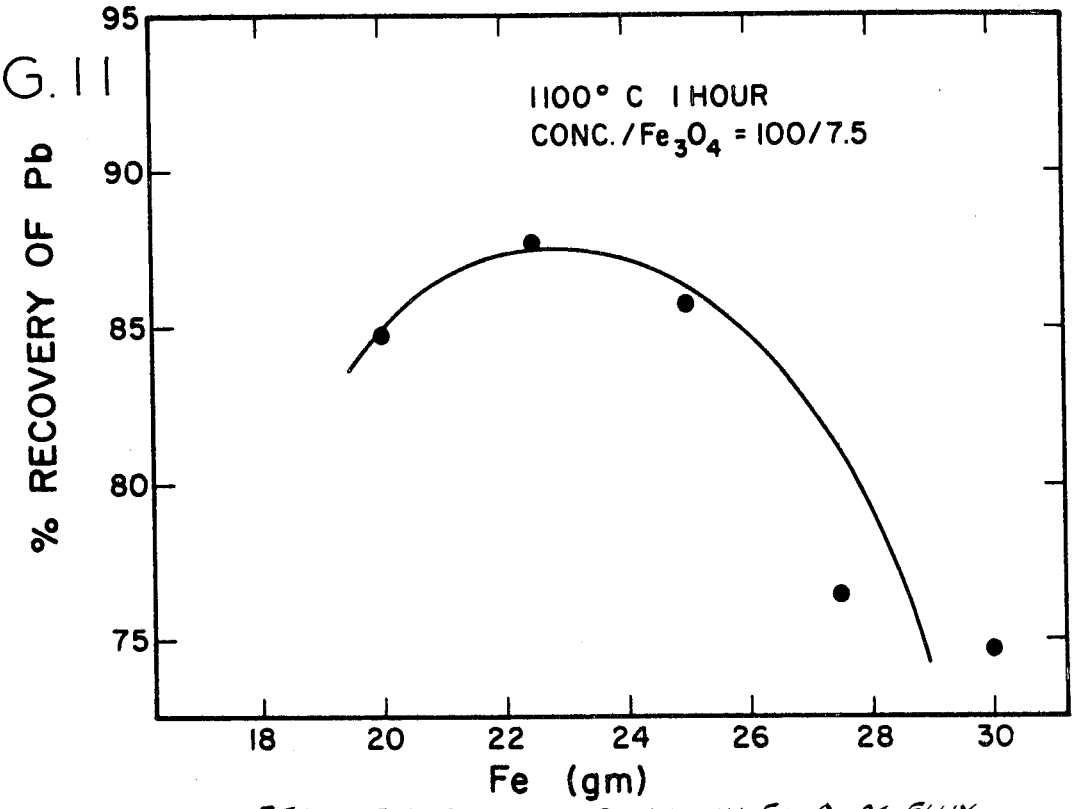
FIG. 11 is a plot of lead recovery against iron charge for the runs of Example 9, infra.

Direct smelting runs were carried out in the manner generally described in Example 8, except that the $Fe_3O_4$ charge was held constant at 3 g (a 100:7.5 concentrate: $Fe_3O_4$ ratio), the reaction period was 1 hr. in each run, and the iron content of the charge was varied. The iron content of the charge, and the weight and percentage of recovery of lead are set forth in Table IX, and lead recovery is plotted against the iron content of the charge in FIG. 11.

TABLE IX

| Test | Weight Fe gm | Weight Pb Recovered gm | Recovery Pb % |
|---|---|---|---|
| 9-1 | 8.0 | 25.0 | 84.6 |
| 9-2 | 9.0 | 26.1 | 87.7 |
| 9-3 | 10.0 | 25.4 | 85.7 |
| 9-4 | 11.0 | 22.6 | 76.5 |
| 9-5 | 12.0 | 21.7 | 73.4 |
| 9-6 | 13.0 | 24.7 | 83.4 |

Figure 12:
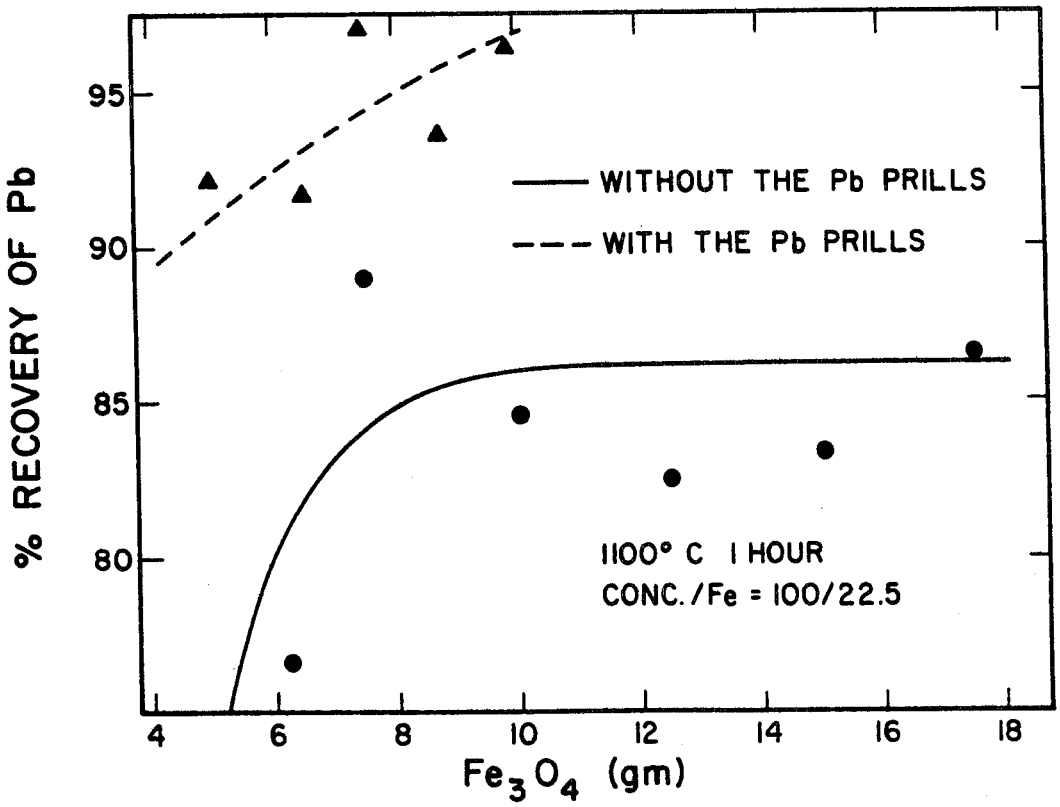
FIG. 12 is a plot of lead recovery against $Fe_3O_4$ charge for further runs of Example 9.

Using a fixed lead concentrate-to-iron ratio of 100:22.5 (40 g concentrate and 9 g iron), additional direct smelting tests were carried out at 1100° C. for 1 hr. with varying $Fe_3O_4$ flux content. The $Fe_3O_4$ charge, and the weight and percentage recovery of lead for each of the latter runs are set forth in Table IXA. The lead recovery is plotted against the $Fe_3O_4$ charge as the circular points, approximated by the solid curve, in FIG. 12.

TABLE IXA

| Test | Weight $Fe_3O_4$ gm | Weight Pb Recovered gm | Recovery Pb % |
|---|---|---|---|
| 9-7 | 3.0 | 26.5 | 89.2 |
| 9-8 | 4.0 | 25.1 | 84.6 |
| 9-9 | 5.0 | 24.6 | 82.7 |
| 9-10 | 6.0 | 24.8 | 83.4 |
| 9-11 | 7.0 | 25.6 | 86.5 |

In the runs whose results are reported in Table IXA, it was observed that numerous particles of metallic lead were entrained in the matte, but these were not included in the measurement of the amount of lead recovered. To determine the effect of entrained lead on the recovery efficiency, another series of runs was carried out under the same conditions as the runs of Table IXA, using generally similar proportions of ingredients. However, the matte produced in these runs was crushed and the larger lead particles separated by screening the crushed matte through a 14 mesh screen. Those particles which did not pass the screen were then weighed and included as part of the total lead recovery. The $Fe_3O_4$ charge, and the weight and percentage recovery of lead for these runs are set forth in Table IXB and depicted as the triangular points approximated by the dotted curve in FIG. 12.

TABLE IXB

| Test | Weight $Fe_3O_4$ gm | Weight* Pb gm | Recovery Pb % |
|---|---|---|---|
| 9-12 | 1.50 | 20.5 | 92.2 |
| 9-13 | 1.87 | 20.5 | 92.2 |
| 9-14 | 2.25 | 21.6 | 97.3 |
| 9-15 | 2.62 | 20.8 | 93.5 |
| 9-16 | 2.99 | 21.4 | 96.5 |

*Lead weight includes Pb prills

Figure 13:
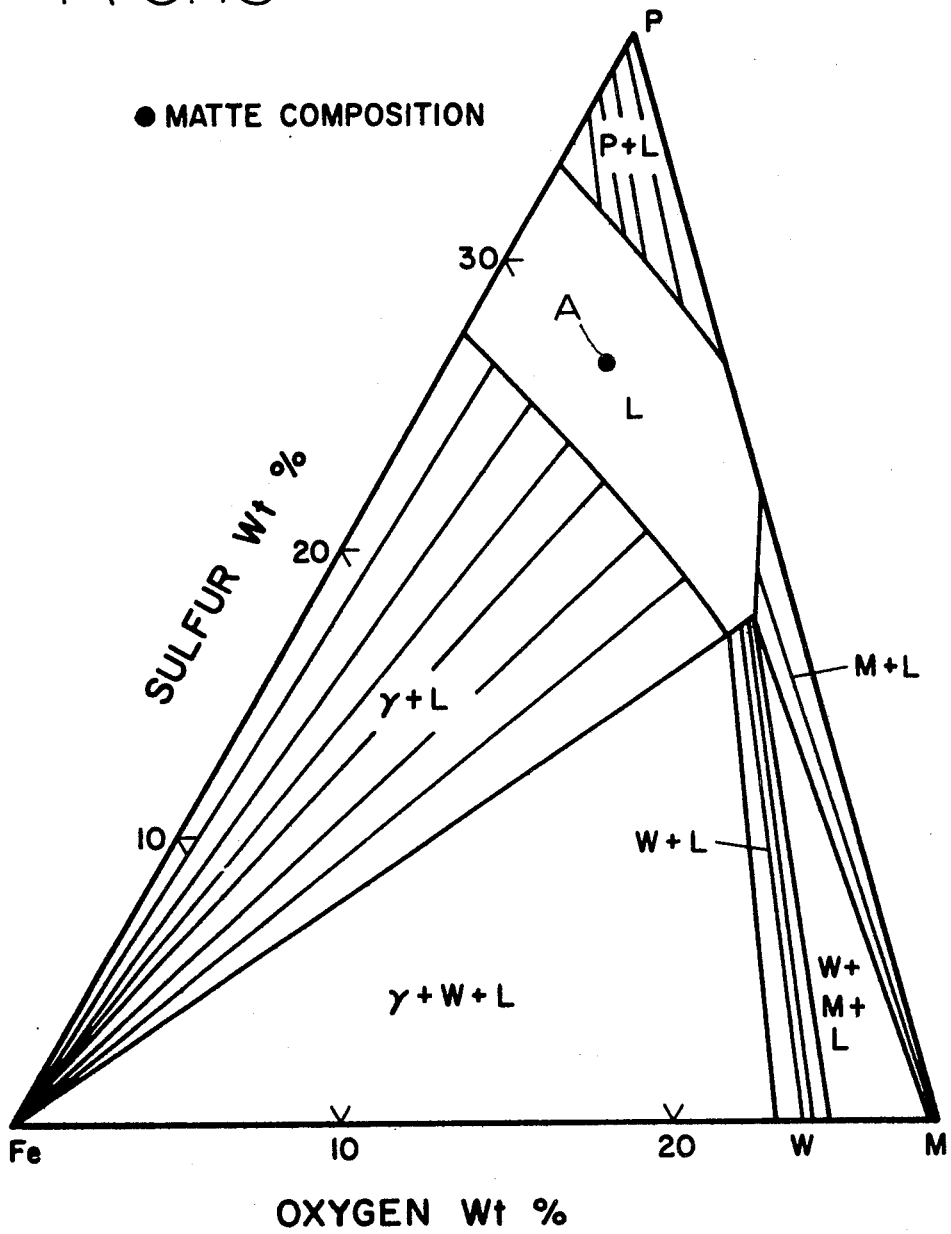
FIG. 13 is an isothermal section of the Fe—O—S system phase diagram on which is plotted a typical matte composition produced by the process of the invention.

The results of the runs of Examples 1–9 indicate that the maximum lead recovery is achieved at a lead concentrate/$Fe_2O_3$/Fe charge ratio of approximately 100:10.8:26, and at a lead concentrate/$Fe_3O_4$/iron charge ratio of approximately 100:10:22.5. For these apparent optimum charge ratios, the finished matte may be calculated to have a composition of about 65.5% iron, 28.0% sulfur and 6.0% oxygen where $Fe_2O_3$ is used as a flux, and approximately 63.5% iron, 31.0% sulfur and 5.5% oxygen where $Fe_3O_4$ is used as the flux. These compositions are calculated on the assumption of 100% PbS reduction, neglecting copper and zinc. A typical matte composition is plotted as point L in the Fe—O—S phase diagram set forth in FIG. 13.

EXAMPLE 10

Figure 14:
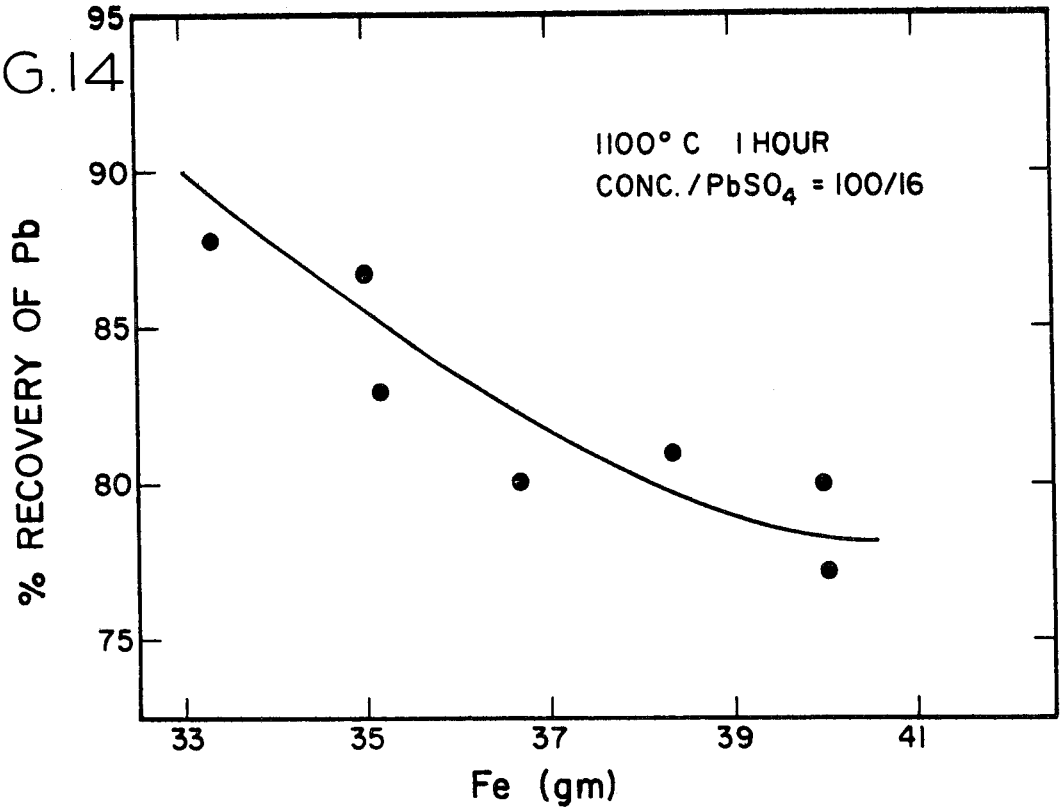
FIG. 14 is a plot of lead recovery against iron content of the charge for the smelting runs of Example 10, infra.

Direct smelting tests were carried out in which a lead concentrate of the type described in Example 5 was reduced with powdered iron using $PbSO_4$ as the flux. Using a concentrate-to-$PbSO_4$ ratio of 100:16 (30 g concentrate and 4.8 g $PbSO_4$), several runs were made at 1100° C. for 1 hr. using varying charges of iron. The iron charge, and the weight and percentage of recovery of lead for the runs of this example are set forth in Table X and lead recovery is plotted against the iron charge in FIG. 14. In determining the lead recovery, the matte was crushed and screened, and the +14 mesh prills recovered from the matte were included in the weight of lead recovered. The lead charge used in the determination of percentage of lead recovery was the sum of the lead content of the concentrate and the lead charged as $PbSO_4$.

TABLE X

| Test | Weight Fe gm | Weight* Pb recovered gm | Recovery Pb % |
|---|---|---|---|
| 10-1 | 10.0 | 19.5 | 87.8 |
| 10-2 | 10.5 | 19.3 | 86.9 |
| 10-3 | 10.7 | 18.5 | 83.0 |
| 10-4 | 11.0 | 17.8 | 80.1 |
| 10-5 | 11.5 | 18.0 | 81.0 |
| 10-6 | 12.0 | 17.8 | 80.1 |

*Lead weight includes Pb prills.

EXAMPLE 11

Figure 15:
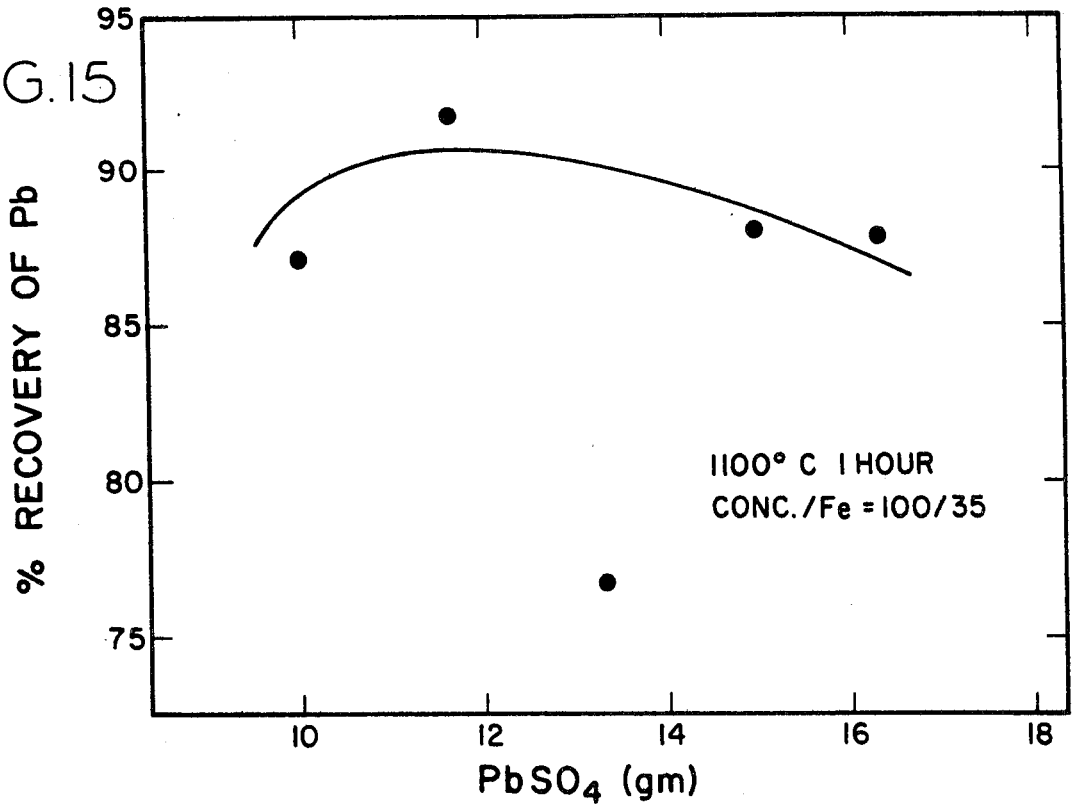
FIG. 15 is a plot of lead recovery against the lead sulfate content of the charge for the runs of Example 11, infra.

Direct smelting tests were carried out in the manner generally described in Example 10, except that the lead concentrate/iron ratio was fixed at 100:33 (30 g concentrate and 10 g iron) while the lead sulfate charge was varied. The lead sulfate content of the charge, and the weight and percentage of recovery of the lead for the runs of this example are set forth in Table XI and lead recovery is plotted against the $PbSO_4$ charge in FIG. 15.

TABLE XI

| Test | Weight $PbSo_4$ gm | Weight* Pb gm | Recovery Pb % |
|---|---|---|---|
| 11-1 | 4.8 | 19.5 | 87.6 |
| 11-2 | 4.5 | 19.4 | 87.5 |
| 11-3 | 4.0 | 17.0 | 76.6 |
| 11-4 | 3.5 | 20.4 | 91.8 |
| 11-5 | 3.0 | 19.3 | 87.0 |

*Lead weight includes the Pb prills.

EXAMPLE 12

Figure 16:
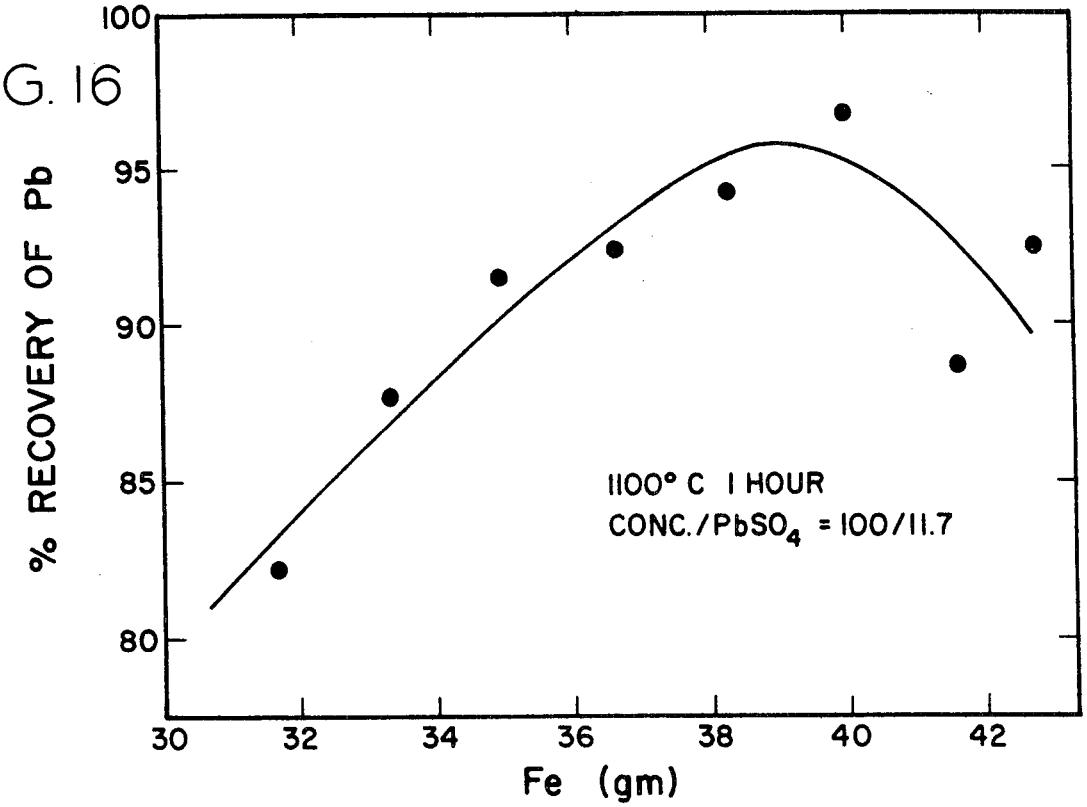
FIG. 16 is a plot of lead recovery against iron content of the charge for the smelting runs of Example 12, infra.

Additional direct smelting tests were carried out using the lead concentrate/$PbSO_4$ ratio indicated to be approximately optimum in the results of Example 11. In the runs of this example, the reaction was carried out at 1100° C. for 1 hr. using varying charges of iron. The iron charged to the crucible, and the weight and percentage recovery of lead for the runs of this example are set forth in Table XII, and the percentage recovery of lead as a function of the iron content of the charge is plotted in FIG. 16. The lead recovery figures for Table XII and FIG. 16 include the +14 mesh prills recovered by crushing and screening the matte.

Based on the results of Examples 11 and 12, the optimum concentrate/$PbSO_4$/iron charge ratio appears to be approximately 100 parts concentrate:11.7 parts $PbSO_4$: 40 parts iron. The relatively high iron consumption results from the need to reduce the lead from the flux as well as from the concentrate and from the absence of any appreciable quantities of sulfur-reducible iron in the charge. Based on the apparent optimum charge ratios, the finished matte may be calculated to have an approximate composition of 68.9% by weight iron, 27.2% by weight sulfur and 3.9% by weight oxygen.

TABLE XII

| Test | Weight Fe gm | Weight* Pb gm | Recovery Pb % |
|---|---|---|---|
| 12-1 | 9.5 | 18.6 | 83.6 |
| 12-2 | 10.0 | 19.5 | 87.8 |
| 12-3 | 10.5 | 20.4 | 91.5 |
| 12-4 | 11.0 | 20.6 | 92.4 |
| 12-5 | 11.5 | 21.0 | 94.3 |

TABLE XII-continued

| Test | Weight Fe gm | Weight* Pb gm | Recovery Pb % |
|---|---|---|---|
| 12-6 | 12.0 | 21.6 | 96.7 |
| 12-7 | 12.5 | 19.8 | 88.9 |
| 12-8 | 13.0 | 20.6 | 92.5 |

*Lead weight includes the Pb prills.

EXAMPLE 13

Figure 17:
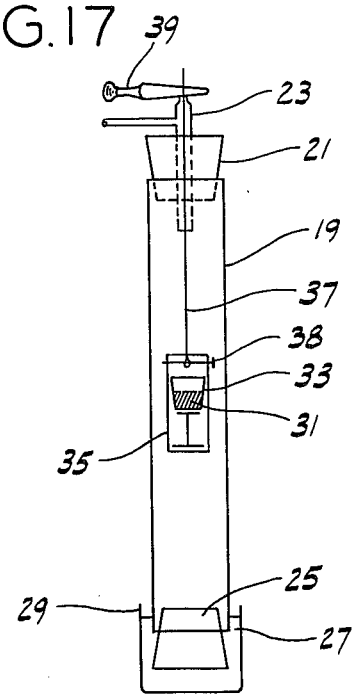
FIG. 17 depicts the furnace arrangement used in determining the extent of sulfur dioxide evolution from the process of the invention as described in Example 13, infra.

The extent of sulfur dioxide evolution from the process of the invention was determined using a tubular furnace of the type shown in FIG. 17. The furnace consists of a mullite tube 19 sealed at its upper end by a rubber stopper 21 and provided with a nitrogen supply through a glass T-tube 23 whose lower leg extends into the tube through stopper 21. The lower end of tube 19 is closed by a rubber stopper 25 and immersed in a water seal 27 in a glass beaker 29. The reaction sample 31 is contained within an iron crucible 33. Crucible 33, in turn, is contained within an alundum thimble 35. Thimble 35 is suspended within tube 19 by a wrought iron wire 37 wrapper around a nail 38 which passes through openings in opposite walls of the thimble. Wire 37 is hung from an alligator clip 39 and extends into tube 19 through a sealed opening in the upper leg of glass T-tube 23.

The furnace was heated by silicon carbide elements and the temperature of the furnace was controlled within ±2° C. by a millivolt pyrometer operating in response to a Pt/Pt-13% Rh control thermocouple inserted near the heating elements of the hot zone of the furnace.

In order to positively exclude oxygen from the tubular furnace, nitrogen was passed into tube 19 through glass T-tube 23 at a rate of 10 cc/min.

Direct smelting runs were carried out using an $Fe_2O_3$ flux with charge ratios of 100 parts concentrate: 10.8 parts by weight flux:26 parts by weight iron powder. Reaction was carried out at 1100° C. for 1 hr. In the course of each run, nitrogen emanating from the furnace tube was passed through a cigarette filter and collected in a syringe. The sample collected in the syringe was then injected through a Kitagawa type C or type D sulfur dioxide detector tube. The contents of the detector tube changed color in response to the presence of sulfur dioxide, and the $SO_2$ content of the gas was determined by comparison with a concentration chart. The sulfur dioxide concentration and lead recovery for each of the runs of this example are set forth in Table XIII.

TABLE XIII

| Test | $SO_2$ Concentration ppm (Volume) | Recovery of Pb % |
|---|---|---|
| 13-1 | 80 | 93.2 |
| 13-2 | 70 | 95.5 |
| 13-3 | 80 | 92.1 |

For the three runs, the average concentration of sulfur dioxide and the nitrogen emanating from the furnace tube was approximately 76 ppm. From the volume of gas passed through the furnace during the reaction (300 cc), it may be calculated that an average of only 0.0325 mg of sulfur evolved from the reaction mixture during the course of the reduction reaction. This corresponds to 0.0007% of the sulfur contained in the crucible charge.

Several additional runs were made in which the maximum theoretical sulfur emission was indicated by weight loss of the contents of the reaction crucible during the reaction. The results of these runs are set forth in Table XIV.

TABLE XV-continued

| d Spacing Angstroms | $I/I_1$* | Compound | d Spacing Angstroms | $I/I_1$ | Compound |
|---|---|---|---|---|---|
| 1.64 | 60–80 | ZnS | 2.55 | 30–60 | FeS or $Fe_3O_4$ |
| 2.04 | 60–80 | Fe | 2.89 | 30–60 | Pb |
| 3.15 | 60–80 | ZnS | | | |

* $I/I_1$ = Relative Intensity

TABLE XVI

| d Spacing Angstrom | $I/I_1$* | Compound | d Spacing Angstrom | $I/I_1$* | Compound |
|---|---|---|---|---|---|
| 2.85 | 80–100 | $Ca_2MgSi_2O_7$ | 1.56 | 30–60 | $Ca_2MgSiO_7$ |
| 2.48 | 80–100 | $Ca_2MgSi_2O_7$ | 1.59 | 30–60 | $Ca_2MgSi_2O_7$ |
| 1.39 | 60–80 | $Ca_2MgSi_2O_7$ | 1.91 | 30–60 | $Ca_2MgSi_2O_7$ |
| 1.74 | 60–80 | $Ca_2MgSi_2O_7$ | 2.03 | 30–60 | $Ca_2MgSi_2O_7$ |
| 1.76 | 60–80 | $Ca_2MgSi_2O_7$ | 2.28 | 30–60 | $Ca_2MgSi_2O_7$ |
| 1.81 | 60–80 | $CaMgSiO_4$ | 2.39 | 30–60 | $Ca_2MgSi_2O_7$ |
| 2.55 | 60–80 | $Fe_3O_4$ | 2.94 | 30–60 | $CaMgSiO_4$ |
| 2.57 | 60–80 | $CaMgSiO_4$ | 163 | 10–30 | $CaMgSiO_4$ or $Fe_3O_4$ |
| 2.65 | 60–80 | $CaMgSiO_4$ | 3.1 | 10–30 | $Ca_2MgSi_2O_7$ |
| 2.44 | 60–80 | $Ca_2MgSi_2O_7$ | 3.5 | 10–30 | $Ca_2MgSi_2O_7$ |
| 1.43 | 30–60 | $Ca_2MgSi_2O_7$ | 3.60 | 10–30 | $CaMgSiO_4$ |
| 1.49 | 30–60 | $Fe_3O_4$ | 3.89 | 10–30 | $CaMgSiO_4$ |
| 1.52 | 30–60 | $Fe_3O_4$ | | | |

* $I/I_1$ = Relative Intensity

TABLE XIV

| Test | Initial Weight gm | Final Weight gm | Weight Change gm | Recovery of Pb % |
|---|---|---|---|---|
| 14-1 | 65.652 | 65.652 | 0.0 | 92.7 |
| 14-2 | 65.876 | 65.817 | 0.059 | 94.1 |

EXAMPLE 14

Further direct smelting runs were made in which the matte and slag (a small black spongy mass) were examined by X-ray diffraction in order to determine the compounds contained therein. In order to provide sufficient material for phase identification, approximately 120–180 g of lead concentrate and proportionately large amounts of flux and iron were charged in the reaction mixtures of this example. To accommodate the larger reaction mixtures (4–6 times the amount used in the foregoing examples), a larger reaction vessel was provided by welding a 7.5 cm mild steel tube to the top of a standard 25 cc iron crucible.

The charge ratio for each of the runs of this example was 100 parts concentrate:10.8 parts $Fe_2O_3$:26 parts iron powder. The reaction was carried out for 1½ hrs. at 1100° C., and the reaction product was then cooled over a 5-hr. period. Thereafter, the reactor was sectioned in half along its long axis by means of a band saw. X-ray patterns of the matte and black sponge slag were obtained using a Norelco X-ray diffractometer with iron tube and manganese filter, following the powder method described by Cullity "Elements of X-ray Diffraction," Addison-Wesley Publishing Company, Inc., 1956, pages 149–154. Each sample was ground to −200 mesh and exposed for 10 hrs. The X-ray diffraction patterns of the matte and slag are set forth in Tables XV and XVI, respectively.

TABLE XV

| d Spacing Angstroms | $I/I_1$* | Compound | d Spacing Angstroms | $I/I_1$ | Compound |
|---|---|---|---|---|---|
| 1.72 | 80–100 | FeS | 2.49 | 60–80 | FeO |
| 2.08 | 80–100 | FeS | 1.24 | 30–60 | FeS |
| 2.16 | 80–100 | FeO | 1.42 | 30–60 | Fe or FeS |
| 2.67 | 80–100 | FeS | 1.45 | 30–60 | FeS |
| 3.07 | 80–100 | FeS | 1.47 | 30–60 | FeS |
| 1.52 | 60–80 | FeO | 1.49 | 30–60 | Pb or FeS or $Fe_3O_4$ |
| 1.92 | 60–80 | ZnS | 1.59 | 30–60 | FeS |
| 1.93 | 60–80 | FeS | 2.47 | 30–60 | Pb |

EXAMPLE 15

A lead concentrate of the type described in Example 5 (180g) was smelted using a $Fe_2O_3$ flux (18 g) and iron powder (49.5 g), a concentrate/$Fe_2O_3$/Fe ratio of 100:10.8:27. The reaction was carried out at 1100° C. for 1½ hrs. using the enlarged crucible of the type described in Example 14 contained in the tubular furnace depicted in FIG. 17 and described in Example 13. After the reaction was complete, the reaction product was cooled over a 5-hr. period. Each phase was then weighed and subjected to chemical analysis for quantitative determination of the principal elements present. The analysis for each phase is shown in Table XVII.

TABLE XVII

| Element | Metal % | Matte % | Black Sponge % |
|---|---|---|---|
| Pb | 99.5 | 8.4 | 8.8 |
| Cu | 0.35 | 1.9 | 0.2 |
| Fe | 0.07 | 58.8 | 21.1 |
| Zn | 0.01 | 2.0 | 2.2 |
| S | 0.08 | 23.9 | 2.5 |
| O | + | 4.26 | 28.47 |
| Si | + | + | 9.81 |
| Ca | + | + | 8.36 |
| Mg | + | + | 4.85 |

+Not analyzed

From the above data and the weight of each of the products of the reaction, a material balance was calculated as shown in Table XVIII. This balance reflects minor analytical or sampling errors with regard to iron and sulfur. Also, neither the X-ray nor the chemical analysis indicated definitely whether the lead in the matte was present as metallic prills or as unreduced lead sulfide.

TABLE XVIII

| Phase | Calculated Wt. of Elements from Chemical Analysis gm | | | | | | Actual Wt. of Each Phase gm |
|---|---|---|---|---|---|---|---|
| | Pb | Cu | Zn | Fe | S | O | |
| Sponge | 0.8 | 0.0 | 0.2 | 1.9 | 0.2 | 2.6 | 9.2 |
| Matte | 9.1 | 2.1 | 2.2 | 63.2 | 25.8 | 4.6 | 107.7 |
| Lead | 123.0 | 0.4 | 0.0 | 0.1 | 0.1 | | 123.6 |
| Total | 132.9 | 2.5 | 2.4 | 65.2 | 26.1 | 7.2 | 240.50* |
| Wt. Loss | | | | | | | |

TABLE XVIII-continued

| Phase | Calculated Wt. of Elements from Chemical Analysis gm | | | | | | Actual Wt. of Each Phase gm |
|---|---|---|---|---|---|---|---|
| | Pb | Cu | Zn | Fe | S | O | |
| or (gain) | 0.6 | 0.6 | 0.7 | (1.5) | (1.9) | 0.7 | |

*about 7.8 gm lost during removal of sample from crucible

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. A process for recovery of lead from a lead sulfide concentrate comprising the steps of:

preparing a furnace charge comprising said concentrate, a source of elemental iron, and a source of available oxygen capable of reacting with the sulfur of the concentrate to form an oxysulfide matte, said concentrate, said source of elemental iron and said source of oxygen being present in such relative proportions that the sum of the elemental iron content and sulfur-reducible combined iron content of the charge is at least about 1.1 pound atoms per pound atom of sulfur based on the total sulfur content of the charge, and the oxygen source provides between about 0.25 and 0.5 pound atom available oxygen per pound atom of sulfur based on the total sulfur content of the charge;

heating the charge to a temperature of at least about 1050° C.;

maintaining said charge at a temperature of at least about 1050° C. to effect reduction of lead sulfide with elemental iron while limiting access of air to said charge to substantially prevent formation of sulfur dioxide therein, thereby causing formation of elemental lead and a matte containing partially oxygenated iron sulfide without substantial evolution of sulfur dioxide; and separating said elemental lead from said matte.

2. A process as set forth in claim 1 wherein the source of elemental iron is in a finely divided state and the sum of the elemental iron content and sulfur-reducible iron content of the charge is not substantially greater than about 1.5 pound atoms per pound atom sulfur based in the total sulfur content of the charge.

3. A process as set forth in claim 1 wherein said oxygen source is selected from the group consisting of oxides of iron, oxides of lead, oxides of copper, $MnO_2$, $Mn_2O_3$, $Mn_3O_4$, the sulfates of iron, sulfates of lead, sulfates of copper, sulfates of manganese, nitrates of iron and nitrates of lead.

4. A process as set forth in claim 3 wherein said oxygen source is an oxide of iron.

5. A process as set forth in claim 1 wherein said charge is heated to a temperature of at least about 1100° C. and maintained at least about 1100° C. during reduction of lead sulfide.

6. A process as set forth in claim 5 wherein reaction is carried out for between about ½ and about 1½ hours.

* * * * *